US010247457B2

(12) United States Patent
Gu et al.

(10) Patent No.: US 10,247,457 B2
(45) Date of Patent: Apr. 2, 2019

(54) NON-CONDENSABLE GAS PURGE SYSTEM FOR REFRIGERATION CIRCUIT

(71) Applicant: Daikin Applied Americas Inc., Minneapolis, MN (US)

(72) Inventors: Yian Gu, Milwaukee, WI (US); Fumiaki Onodera, Minnetonka, MN (US); Aaron Schoolcraft, Mound, MN (US); Tsuyoshi Ueda, Plymouth, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 401 days.

(21) Appl. No.: 15/136,137

(22) Filed: Apr. 22, 2016

(65) Prior Publication Data

US 2017/0307269 A1 Oct. 26, 2017

(51) Int. Cl.
*F25B 43/00* (2006.01)
*F25B 43/04* (2006.01)
(Continued)

(52) U.S. Cl.
CPC ..... *F25B 43/043* (2013.01); *F25B 31/00* (2013.01); *F25B 41/04* (2013.01); *F25B 43/003* (2013.01);
(Continued)

(58) Field of Classification Search
CPC ..... F25B 43/043; F25B 43/003; F25B 31/00; F25B 41/04; F25B 43/006;
(Continued)

(56) References Cited

U.S. PATENT DOCUMENTS 1,169,356 A * 1/1916 Sanderson ..... F03B 13/1815 60/498
4,169,356 A * 10/1979 Kingham ..... F25B 7/00 62/335
(Continued)

FOREIGN PATENT DOCUMENTS

JP 2010-531970 A 9/2010
WO 2009/114398 A1 9/2009

OTHER PUBLICATIONS

The International Search Report for the corresponding international application No. PCT/US2017/028535 dated Jul. 25, 2017.
(Continued)

*Primary Examiner* — Henry T Crenshaw
(74) *Attorney, Agent, or Firm* — Global IP Counselors, LLP

(57) ABSTRACT

A non-condensable gas purge system is configured to be used in a chiller system that uses a low pressure refrigerant in a loop refrigeration circuit. The non-condensable gas purge system includes a purge tank and a purge heat exchanger coil arranged inside the purge tank. The purge tank has a tank inlet for receiving the low pressure refrigerant from a condenser of the refrigeration circuit, a tank outlet for returning the low pressure refrigerant to an evaporator of the refrigeration circuit, and a purge outlet for purging non-condensable gas from the purge tank to the ambient atmosphere. The purge heat exchanger coil is fluidly connected to the loop refrigeration circuit such that the low pressure refrigerant contained in the loop of the chiller system can pass through the purge heat exchanger coil. Refrigerant in the purge tank is condensed by the heat exchanger coil while non-condensable gases remain gaseous.

20 Claims, 16 Drawing Sheets

(51) Int. Cl.

| | |
|---|---|
| ***F25B 31/00*** | (2006.01) |
| ***F25B 41/04*** | (2006.01) |
| *F25B 1/10* | (2006.01) |
| *F25B 49/02* | (2006.01) |

(52) U.S. Cl.
CPC ..... *F25B 43/006* (2013.01); *F25B 1/10* (2013.01); *F25B 49/02* (2013.01); *F25B 2341/0662* (2013.01); *F25B 2400/13* (2013.01); *F25B 2400/23* (2013.01); *F25B 2600/2519* (2013.01); *F25B 2700/04* (2013.01); *F25B 2700/19* (2013.01); *F25B 2700/2109* (2013.01)

(58) Field of Classification Search
CPC ..... F25B 2600/2519; F25B 2341/0662; F25B 2400/23; F25B 2400/13; F25B 2700/04; F25B 49/02; F25B 1/10; F25B 2700/19; F25B 2700/2109
USPC ..... 62/195
See application file for complete search history.

(56) References Cited

U.S. PATENT DOCUMENTS

| | | | | |
|---|---|---|---|---|
| 5,187,953 | A * | 2/1993 | Mount | F25B 43/04 62/195 |
| 5,313,805 | A * | 5/1994 | Blackmon | F25B 43/043 62/195 |
| 5,400,613 | A * | 3/1995 | O'Neal | F25B 43/043 62/195 |
| 5,806,322 | A * | 9/1998 | Cakmakci | B01D 53/04 62/195 |
| 2010/0326095 | A1 | 12/2010 | Van Horn et al. | |
| 2015/0107279 | A1* | 4/2015 | Sanhaji | F25B 45/00 62/85 |

OTHER PUBLICATIONS

International Preliminary Report on Patentability including Written Opinion for the corresponding international application No. PCT/US2017/028535, dated Oct. 23, 2018.

* cited by examiner

NON-CONDENSABLE GAS PURGE SYSTEM FOR REFRIGERATION CIRCUIT

BACKGROUND

Field of the Invention

The present invention generally relates to a system for purging non-condensable gas from a refrigeration circuit, and a refrigeration circuit equipped with the purge system. More specifically, the present invention relates to system for purging non-condensable gas from a chiller circuit that uses a low pressure type refrigerant without requiring a separate dedicated compressor.

Background Information

A refrigeration circuit for a chiller system typically includes a purge system for removing non-condensable gases from the refrigerant circuit. Accumulation of non-condensable gases in the refrigeration circuit can degrade the operating efficiency of the chiller system. The purge system removes the accumulated non-condensable gases to prevent or suppress such a degradation of the operating efficiency.

A conventional purge system has a complete refrigeration circuit that includes a condenser, an expansion valve, a heat exchanger coil (evaporator coil), and a dedicated compressor (which is separate from the compressor of the main refrigeration circuit of the chiller system). The purge system also includes a purge tank that defines a condensing chamber and houses the heat exchanger coil of the purge system refrigeration circuit. The purge tank has an inlet for introducing refrigerant containing non-condensable gases from the main refrigeration circuit of the chiller system to the condensing chamber, an outlet for returning condensed refrigerant back to the main refrigeration circuit from the condensing chamber, and a purge outlet for purging accumulated non-condensable gases to the ambient atmosphere. A purge line communicating to the ambient atmosphere is connected to the purge outlet, and a pump-out compressor and a carbon filter or other device for removing residual refrigerant from purged gases are provided in the purge line. The purge line also includes valves for opening and closing different sections of the purge line.

Refrigerant containing non-condensable gases is introduced into the condensing chamber of the purge tank from the main refrigeration circuit and condensed by the evaporator coil. Liquid refrigerant collects in the bottom of the condensing chamber and the non-condensable gases accumulate in the condensing tank and remain in a gaseous state. Periodically, the non-condensable gases are purged from the condensing chamber by opening the valves of the purge line and operating the pump-out compressor to draw the non-condensable gas from the condensing chamber and pump the non-condensable gas out to the atmosphere. When the non-condensable gas is purged, residual refrigerant exiting the condensing chamber along with the non-condensable gas is captured by the carbon filter such that the refrigerant is not released to the atmosphere. FIG. 14 shows a schematic view of a conventional chiller system equipped with a conventional purge system. Also, Japanese Patent Application Publication No. 2010-531970 (which corresponds to International Patent Application Publication No. WO2009-114398) discloses a purge system installed in a chiller system that uses a low pressure refrigerant.

SUMMARY

A conventional purge system has a comparatively large footprint because it includes a complete refrigeration circuit with a dedicated compressor as explained above. A conventional purge system also requires a dedicated controller to control the refrigeration cycle (compressor) of the purge system refrigeration circuit and to operate the valves and the pump-out compressor when the accumulated non-condensable gas is exhausted from the condensing chamber (e.g., see FIG. 14). Consequently, the conventional purge system is somewhat complex and expensive.

Therefore, objects of the present invention include providing a relatively smaller, simpler, and less expensive purge system for a chiller system or other refrigeration circuit that utilizes a low pressure refrigerant.

It has been discovered that when a low pressure refrigerant (e.g., R1233zd) is used in the main refrigeration circuit of a chiller system, it is possible to direct a portion of refrigerant from the main refrigeration circuit to the purge system for condensing the refrigerant in the condensing chamber of the purge tank. In other words, a portion of refrigerant from the main refrigeration circuit is passed through the heat exchanger coil of the purge tank. In this way, the purge system can share the same low pressure refrigerant as is used in the main refrigeration circuit of the chiller system. As a result, it is not necessary to provide a separate type of refrigerant for the purge system.

It has been further discovered that a dedicated compressor for the purge system is not necessary if the components of the purge system are arranged appropriately with respect to the components of the main refrigeration circuit and the inlet and outlet of the heat exchanger coil of the purge tank are connected to appropriate portions of the main refrigeration circuit. Thus, the purge system can be simplified by eliminating the need for a dedicated compressor and a complete dedicated refrigeration circuit for the purge system. Consequently, the size and cost of the purge system can be significantly reduced.

It has been further discovered that a dedicated controller for the purge system may not be required when the heat exchanger coil is connected to the main refrigeration circuit and the dedicated compressor of the conventional purge system is eliminated. In other words, since the proposed purge system does not require a complete dedicated refrigeration circuit, the proposed purge system is simpler to operate and a separate controller may not be necessary. Thus, for example, the main controller of the chiller system can control the purge system as well.

Based on these discoveries, the forgoing objects can basically be achieved by providing a non-condensable gas purge system having a purge heat exchanger coil configured to be connected to a refrigeration circuit. The non-condensable gas purge system is configured to be connected to a refrigeration circuit that includes a compressor, a condenser, an expansion valve, and an evaporator connected to form a loop. The refrigeration circuit contains a low pressure refrigerant. The purge system comprises a purge tank and the purge heat exchanger coil. An interior of the purge tank defines a liquid condensing chamber. The purge tank has a tank inlet for receiving the low pressure refrigerant from the condenser of the refrigeration circuit, a tank outlet for returning the low pressure refrigerant from the liquid condensing chamber to the evaporator of the refrigeration circuit, and a purge outlet for purging non-condensable gas from the liquid condensing chamber to an ambient atmosphere. The purge heat exchanger coil is disposed inside the liquid condensing chamber of the purge tank. The purge heat exchanger coil is configured to be fluidly connected to the refrigeration circuit such that the low pressure refrigerant contained in the loop can pass through the purge heat exchanger coil without using a dedicated purge system compressor.

Additionally, the forgoing objects can basically be achieved by providing a refrigeration circuit for a chiller system and providing a non-condensable gas purge system having a purge heat exchanger coil connected to the loop of the refrigeration circuit so as to share the same refrigerant as is contained in the loop. The refrigeration circuit includes the loop and the non-condensable gas purge system. The loop contains a low pressure refrigerant and comprises a compressor, a condenser, an expansion valve, and an evaporator connected together. The non-condensable gas purge system includes a purge tank, a vapor feed line, a liquid return line, a purge vent line, and a purge heat exchanger coil. The purge tank has an interior defining a liquid condensing chamber. The purge tank also has a tank inlet, a tank outlet, and a purge outlet. The vapor feed line is connected to the tank inlet and arranged to feed the low pressure refrigerant from the condenser to the liquid condensing chamber. The liquid return line is connected to the tank outlet and arranged to return the low pressure refrigerant from the liquid condensing chamber to the evaporator. The purge vent line is connected to the purge outlet and arranged to guide non-condensable gas from the liquid condensing chamber to an ambient atmosphere. The purge heat exchanger coil is disposed inside the liquid condensing chamber of the purge tank. The purge heat exchanger coil is fluidly connected to the loop such that the low pressure refrigerant contained in the loop can pass through the purge heat exchanger coil without using a dedicated purge system compressor.

These and other objects, features, aspects and advantages of the present invention will become apparent to those skilled in the art from the following detailed description, which, taken in conjunction with the annexed drawings, discloses a preferred embodiment.

BRIEF DESCRIPTION OF THE DRAWINGS

Referring now to the attached drawings which form a part of this original disclosure.

DETAILED DESCRIPTION OF EMBODIMENT(S)

Select embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
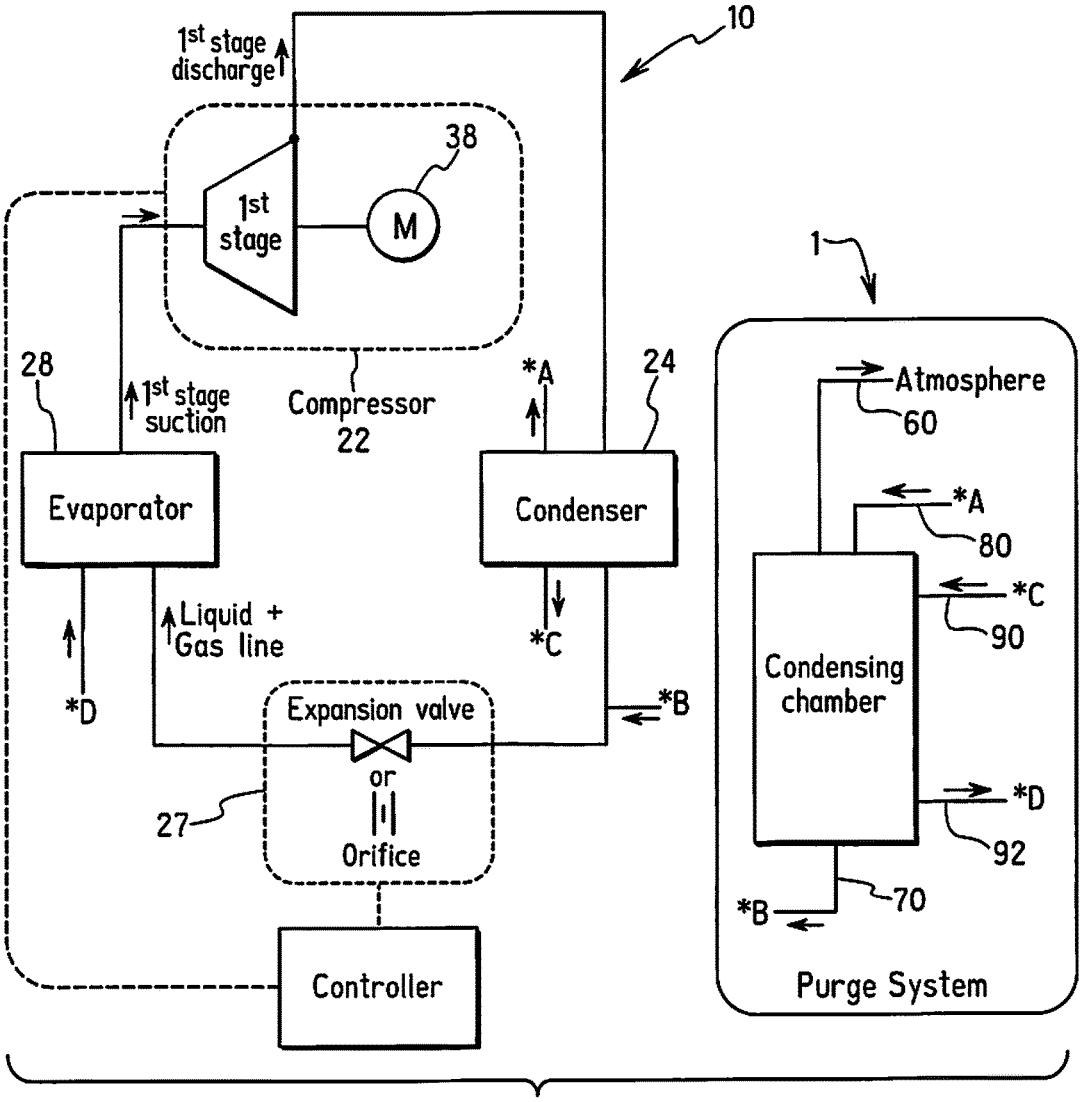
FIG. 1 is a schematic diagram illustrating a single stage chiller system having a non-condensable gas purge system in accordance with an embodiment of the present invention.

Referring initially to FIG. 1, a chiller system 10 is illustrated in accordance with an embodiment of the present invention. The chiller system 10 is preferably a water chiller that utilizes cooling water and chiller water in a conventional manner. The chiller system 10 includes a non-condensable gas purge system 1 (explained later) in accordance with the present invention. The chiller system 10 illustrated in FIG. 1 is a single stage chiller system. However, it will be apparent to those skilled in the art from this disclosure that the chiller system 10 could be a multiple stage chiller system 10' (e.g., such as the two-stage chiller system shown in FIG. 2). The chiller system 10 basically includes a chiller controller 20, a compressor 22, a condenser 24, an expansion valve (or orifice) 27, and an evaporator 28 connected together in series to form a loop refrigeration circuit. The two-stage chiller system 10' shown in FIG. 2 has a two-stage compressor 22' and further includes an economizer 26. In addition, various sensors (not shown) are disposed throughout the circuit to provide detection data to the chiller controller 20. The chiller systems 10 and 10' are conventional except that the chiller systems 10 and 10' use a low pressure refrigerant (e.g., R1233zd) and include a non-condensable gas purge system 1 in accordance with the present invention.

Figure 2:
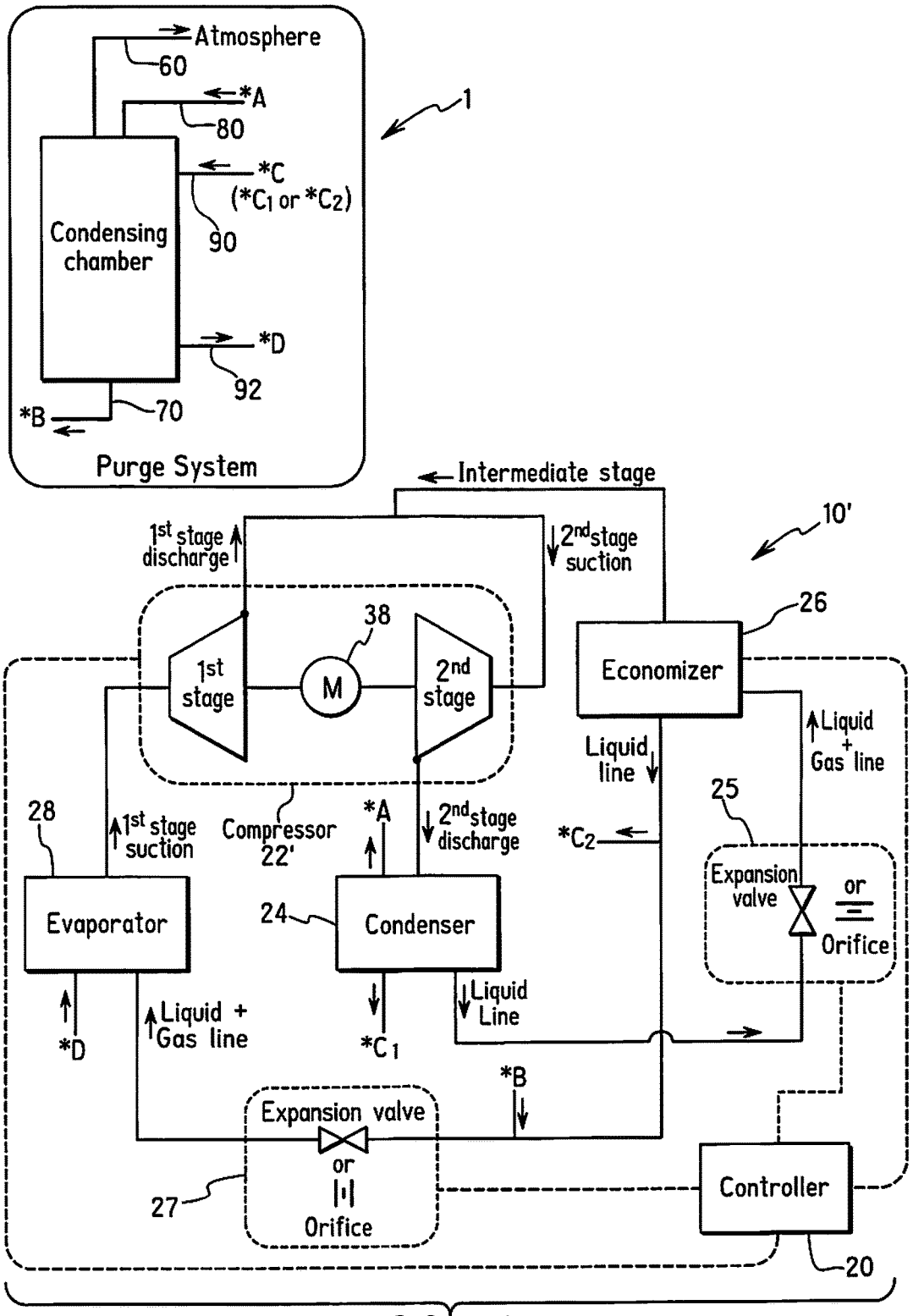
FIG. 2 is a schematic diagram illustrating a two stage chiller system (with an economizer) having a non-condensable gas purge system in accordance with an embodiment of the present invention.

The method of producing refrigeration of the illustrated chiller system 10 includes compressing a low pressure refrigerant composition including R1233zd in the compressor 22. The compressed refrigerant is then sent to the condenser 24 where heat is transferred from the refrigerant to a medium (water in this case). The refrigerant cooled in the condenser 24 is then expanded by the expansion valve 27 and sent to the evaporator 28. In the evaporator 28, the refrigerant absorbs heat from the medium (water in this case) to chill the medium. In this way, refrigeration is produced. The refrigerant is then sent back to the compressor 22 and the cycle is repeated in a conventional manner. The method of producing refrigeration of the illustrated chiller system 10' shown in FIG. 2 is basically the same as the chiller system 10 shown in FIG. 1 except that, in the chiller system 10', a two-stage compressor 22' is used instead of the single stage compressor 22 and an economizer 26 is also included in the refrigeration circuit.

Figure 14:
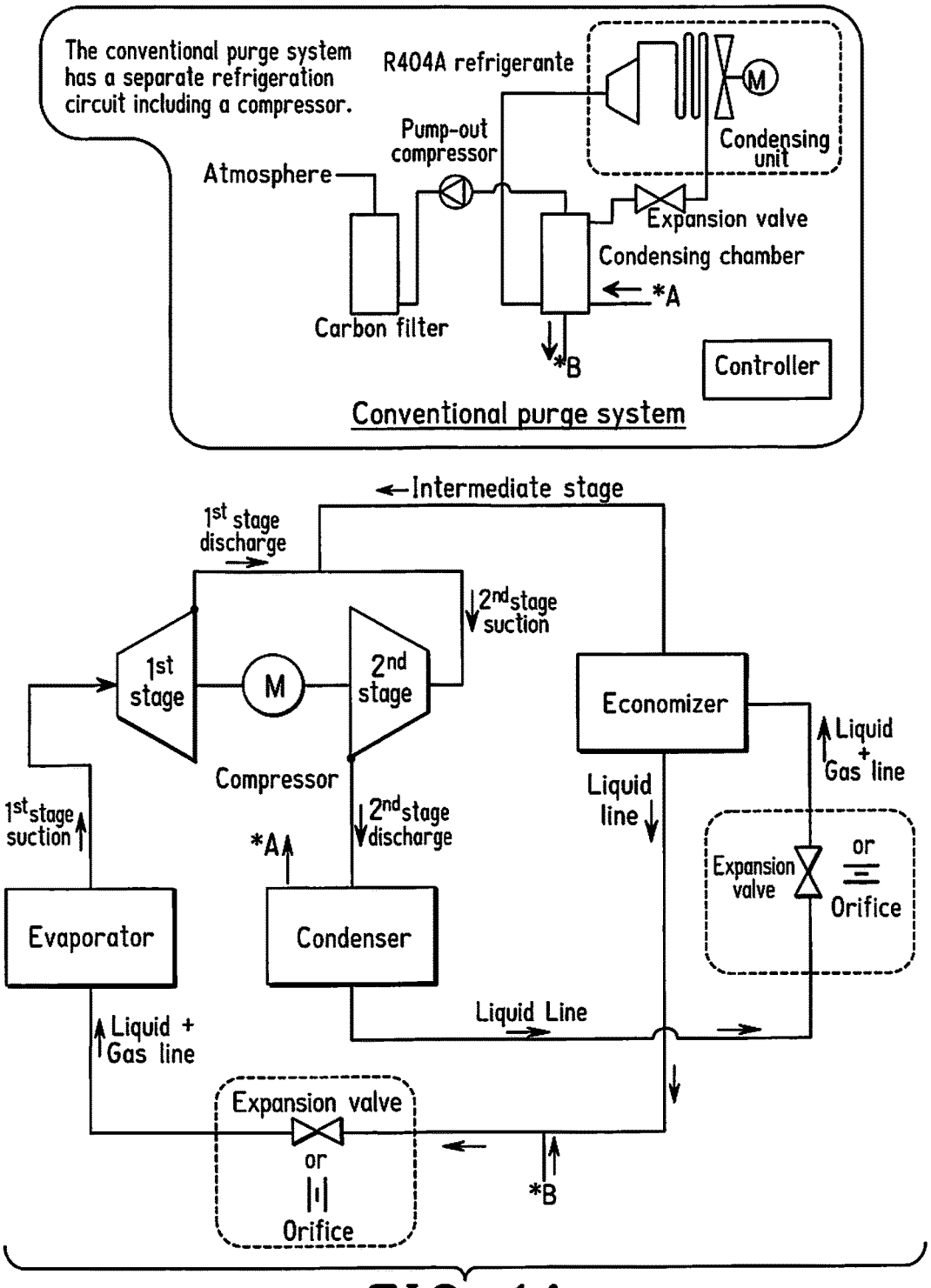
FIG. 14 (PRIOR ART)
FIG. 14 is schematic diagram illustrating a refrigeration circuit equipped with a conventional purge system.

The components of the non-condensable gas purge system 1 will now be explained with reference to FIGS. 3-9. The non-condensable gas purge system 1 includes a purge tank 51 and a purge heat exchanger coil 55 arranged inside the purge tank 51. An interior of the purge tank 51 defines a liquid condensing chamber 53. The purge tank 51 has a tank inlet 52 for receiving the low pressure refrigerant from the condenser 24 of the refrigeration circuit, a tank outlet 54 for returning the low pressure refrigerant from the liquid condensing chamber 53 to the evaporator 28 of the refrigeration circuit, and a purge outlet 56 for purging non-condensable gas from the liquid condensing chamber 53 to the ambient atmosphere. The purge heat exchanger coil 55 is disposed inside the liquid condensing chamber 53 of the purge tank 51. The purge heat exchanger coil 55 is fluidly connected to the loop refrigeration circuit such that the low pressure refrigerant contained in the loop can pass through the purge heat exchanger coil 55. Unlike the conventional purge system illustrated in FIG. 14, the non-condensable gas purge system 1 does not have a dedicated purge system refrigeration circuit or a dedicated purge system compressor. Instead, the non-condensable gas purge system 1 shares the same low pressure refrigerant with the loop refrigeration circuit of the chiller system 10.

More specifically, the purge heat exchanger coil 55 is arranged to receive the low pressure refrigerant in a liquid state from an appropriate portion of the loop refrigeration circuit and return the liquid refrigerant to the evaporator 28. In the illustrated embodiment, purge heat exchanger coil 55 is connected to receive liquid refrigerant from a bottom portion of the condenser 24 (see *C in FIG. 1 and *C1 in FIG. 2). However, in the case of the two-stage chiller system 10', it is also acceptable for the heat exchanger 55 to receive the liquid refrigerant from a liquid line connected to an outlet of the economizer 26 (see *C2 in FIG. 2) instead of from the bottom portion of the condenser 24. A third solenoid valve SV3 is provided between the purge heat exchanger coil 55 and the portion of the loop refrigeration circuit from which the liquid refrigerant is received. An orifice OR may be disposed between the purge heat exchanger coil 55 and the third solenoid valve SV3 to decrease the pressure of the low pressure refrigerant entering the purge heat exchanger coil 55.

Meanwhile, the purge heat exchanger coil 55 is arranged to return the liquid low pressure refrigerant to the evaporator 28. For example, in the illustrated embodiment, the outlet end of the purge heat exchanger coil 55 is connected to a bottom portion of the evaporator 28 (see *D in FIGS. 1 and 2). Thus, the refrigerant that flows through the purge heat exchanger coil 55 of the non-condensable gas purge system 1 is the same low pressure refrigerant that flows through the loop refrigeration circuit of the chiller system 10.

Figure 7:
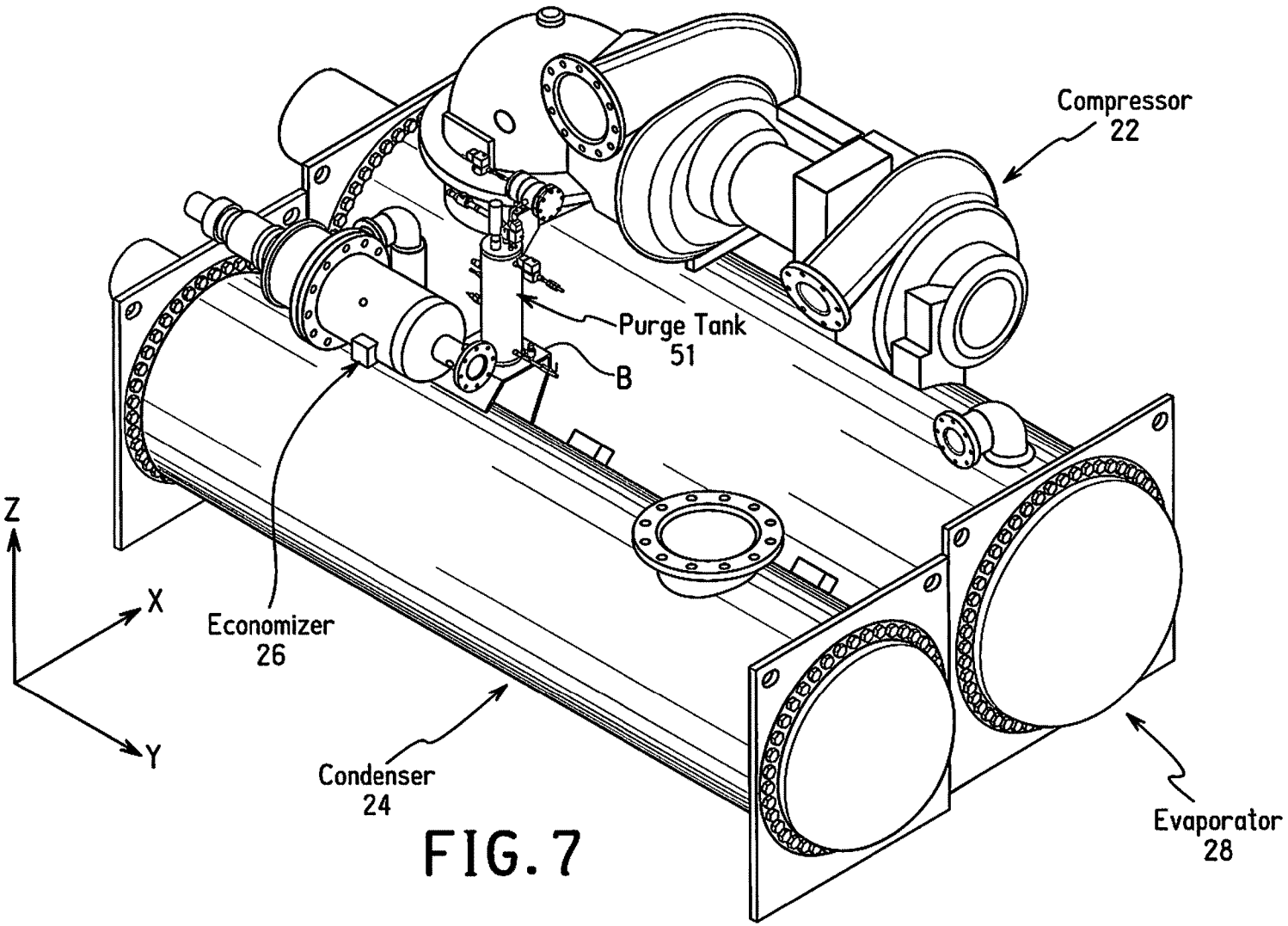
FIG. 7 is a perspective view of a chiller system equipped with the purge system shown in FIGS. 1-6 wherein the purge tank is mounted on the compressor of the chiller refrigeration circuit.
Figure 8:
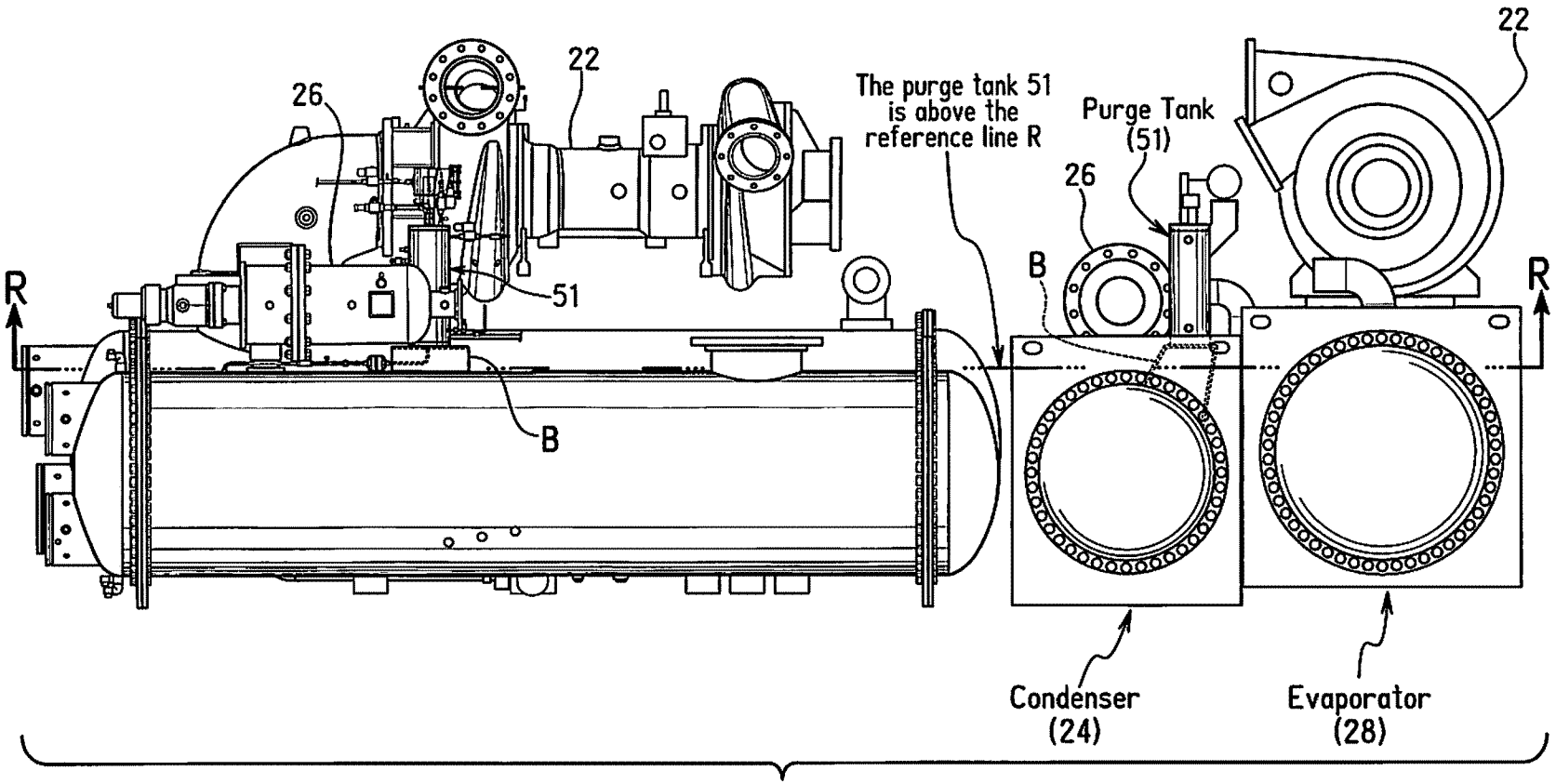
FIG. 8 is a side view (left) and an end view (right) of the chiller system shown in FIG. 7 illustrating the vertical positioning of the purge tank with respect to the condenser and the evaporator.
Figure 9:
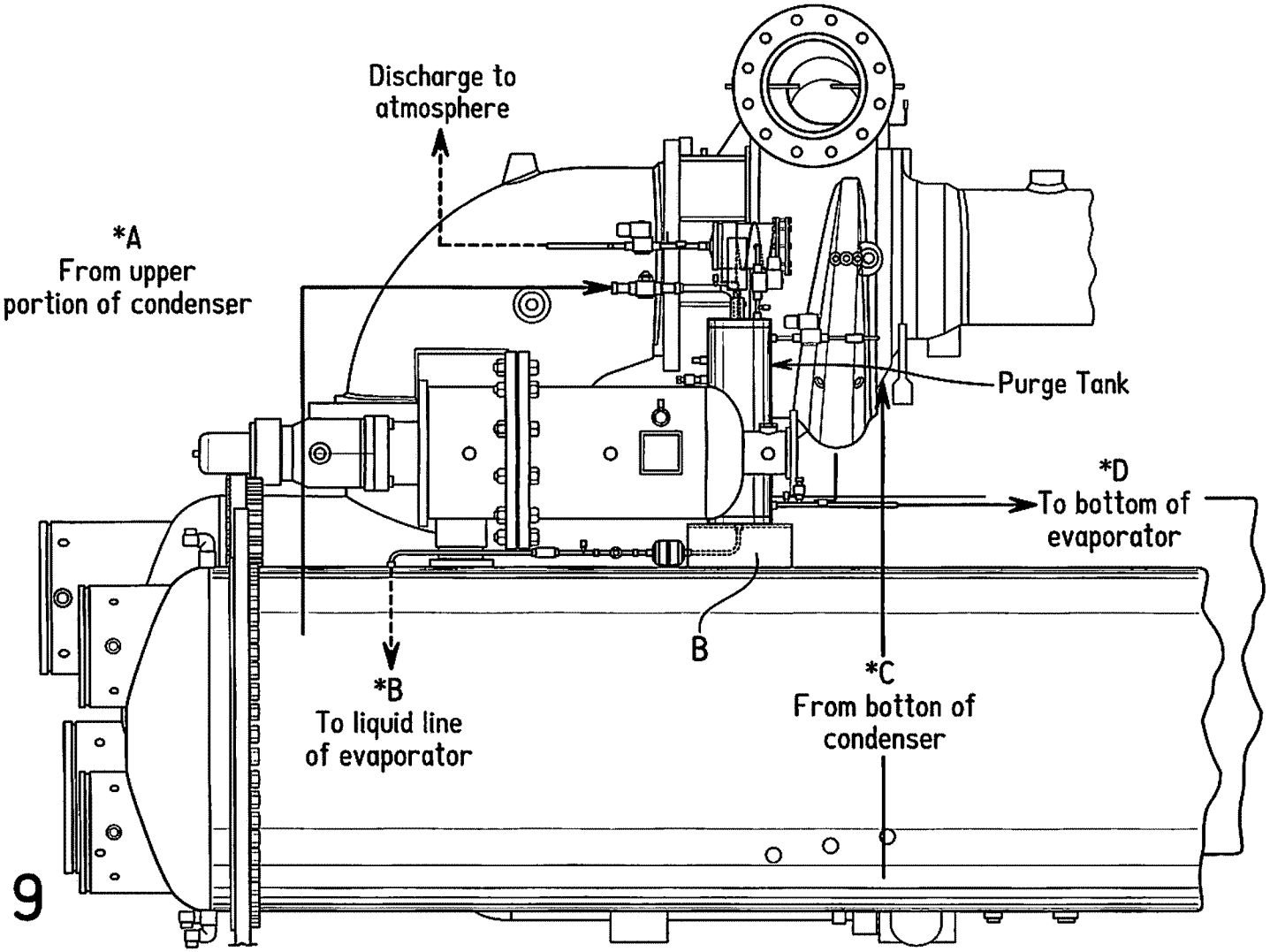
FIG. 9 is an enlarged partial side view of the chiller system shown in FIGS. 7 and 8 explaining the portions of the condenser and the evaporator from which refrigerant is fed to the condensing chamber and the heat exchanger coil, respectively, of the purge system.
Figure 10:
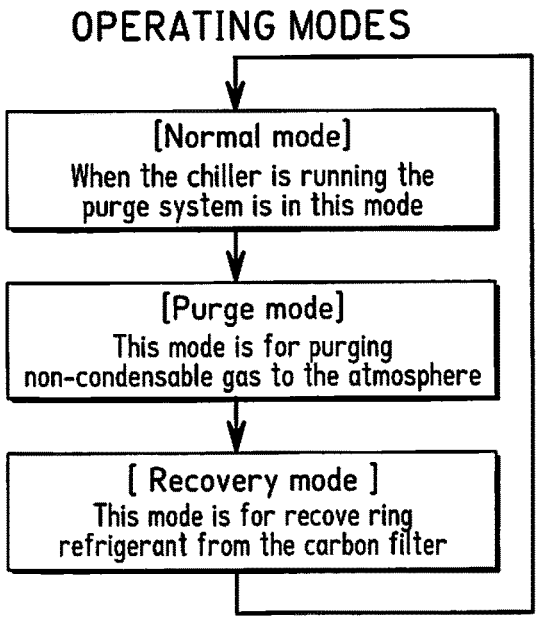
FIG. 10 is a flowchart showing the basic flow of the operating modes of the non-condensable gas purge system.

Referring to FIGS. 7-9, for optimum performance, the purge tank 51 is disposed generally higher than the condenser 24, and, preferably, the purge tank 51 is disposed higher than at least a bottom portion of the evaporator 28. In the illustrated embodiment, the purge tank 51 is arranged above a top surface of the condenser 24, as indicated by the line R shown in FIG. 8. In the illustrated embodiment, the purge tank 51 is also disposed higher than most of the evaporator 28 in the vertical direction.

In the illustrated embodiment, the tank inlet 52 is disposed on an upper portion of the purge tank 51 and the tank outlet 54 is disposed on a lower portion of the purge tank 51. An internal pipe 57 is provided inside the liquid condensing chamber 53 and arranged to extend downward from the tank inlet 52. Preferably, the internal pipe 57 is dimensioned to extend to a position below a predetermined normal liquid level (explained later) of the low pressure refrigerant collected in a liquid state in the liquid condensing chamber 53.

Still referring to FIGS. 3-9, the tank inlet 52 is connected to the condenser 24 by a vapor feed line 80 (see also *A in FIGS. 1 and 2). In the illustrated embodiment, the vapor feed line 80 communicates with an upper portion of the interior of the condenser 24. The vapor feed line 80 serves to supply vapor containing refrigerant and non-condensable gases to the purge tank 51. An isolation valve 84 is provided in the vapor feed line 80 between the tank inlet 52 and the condenser 24. The refrigerant and non-condensable gases entering the purge tank 51 via the tank inlet 52 are guided to a lower portion of the liquid condensing chamber by the internal pipe 57. At least a portion of the non-condensable gases rise through the liquid refrigerant in the liquid condensing chamber 53 and accumulate in the space above the liquid refrigerant. The purge heat exchanging coil 55 serves to condense gaseous refrigerant intermixed with the non-condensable gas in the liquid condensing chamber 53.

The tank outlet 54 is connected to the evaporator 28 by a liquid return line 70 (see also *B in FIGS. 1 and 2). In the illustrated embodiment, the liquid return line 70 is connected to the loop refrigeration circuit at a position upstream of the expansion valve 27, i.e., between the condenser 24 and the expansion valve 27 in the single-stage chiller system illustrated in FIG. 1. A filter drier 72, a sight glass 74, and an isolation valve (e.g., a ball valve) 76 are provided in the liquid return line 70. The liquid refrigerant in the liquid condensing chamber 53 is recovered to the refrigeration circuit of the chiller system 10 due to a combination of head pressure and a pressure difference between the condenser 24 and the liquid condensing chamber 53.

The purge outlet 56 of the purge tank 51 is connected to a purge vent line 60 for venting the liquid condensing chamber 53 to the ambient atmosphere. In the illustrated embodiment, a carbon filter CF and a vacuum pump VP are provided in the purge vent line 60. The carbon filter CF is provided between the vacuum pump VP and the purge outlet 56. The carbon filter CF serves to extract refrigerant from non-condensable gases exiting the purge tank 51 through the purge vent line 60 by adsorption (the present invention is not limited to a carbon filter and any other appropriate device for removing refrigerant intermixed with the non-condensable gas may be used). A heater HE is arranged on the carbon filter CF to heat the carbon filter during a recovery mode (explained later) in order to cause the adsorbed refrigerant to be de-adsorbed from the carbon filter CF and return to the liquid condensing chamber 53. A first solenoid valve SV1 is provided in the purge vent line 60 between the purge outlet 56 and the carbon filter CF, and a second solenoid valve SV2 is provided in the purge vent line 60 between the carbon filter CF and the vacuum pump VP. The vacuum pump VP serves to lower the pressure in the purge vent line 60 such that the non-condensable gases accumulated in the liquid condensing chamber 53 will flow out through the purge outlet 56 and the purge vent line 60 when the pressure inside the liquid condensing chamber 53 is lower than the ambient atmospheric pressure.

Figure 3:
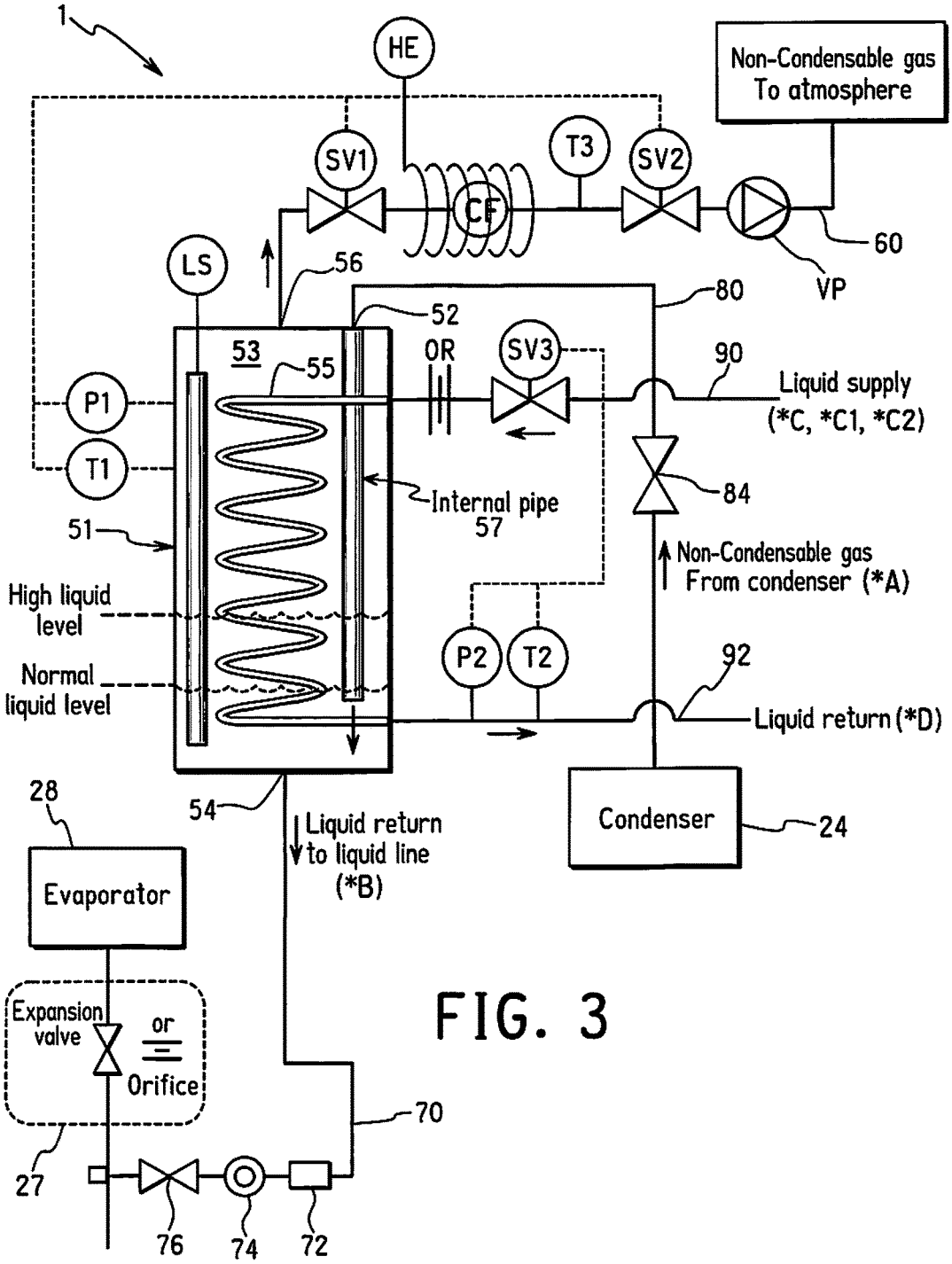
FIG. 3 is a more detailed schematic diagram illustrating the non-condensable gas purge system shown in FIGS. 1 and 2.
Figure 4:
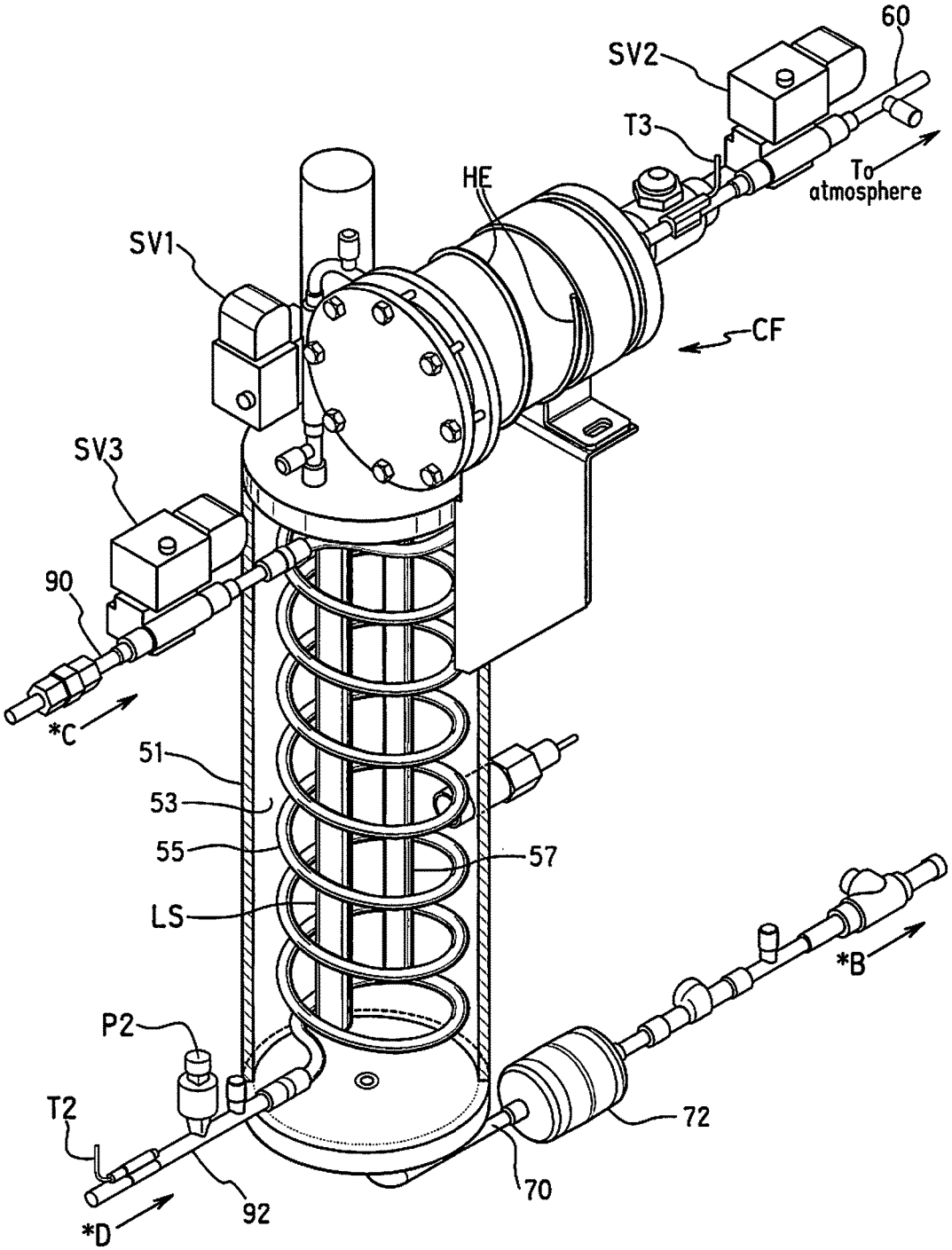
FIG. 4 is a perspective view of the non-condensable gas purge system shown in FIGS. 1-3 with a portion of the purge tank shell cut away to show the components inside the condensing chamber.

As shown in FIGS. 3 and 4, in the illustrated embodiment, a level switch LS is provided inside the purge tank 51 to detect a level of liquid refrigerant accumulated in the bottom of the liquid condensing chamber 53. The level switch LS is configured to detect at least two levels of the liquid refrigerant. In the illustrated embodiment, the level switch is configured to detect when the level of liquid refrigerant has reached a normal liquid level and when the level of the liquid refrigerant has reached a high liquid level that is higher than the normal liquid level. As will be explained later, the normal liquid level and the high liquid level are used to control and open/close state of the third solenoid valve SV3. Although the level switch LS of the illustrated embodiment is configured to detect at least two different liquid levels, the present invention is not limited to an arrangement in which two or more liquid levels are detected. For example, it is acceptable to use a simple level switch (e.g., a float level switch) or other level detector and control the third solenoid valve based on only a single liquid level. Also, the invention is not limited to the level switch LS for detecting the normal liquid level and the high liquid level of the illustrated embodiment. For example, two separate level detectors can be used.

A first pressure sensor P1 and a first temperature sensor T1 are provided on the purge tank 51 to measure a pressure and a temperature, respectively, inside the liquid condensing chamber 53. More specifically, the sensors P1 and T1 detect the pressure and temperature at a position higher than the high liquid level inside the liquid condensing chamber 53 such that the pressure and temperature of non-condensable gas accumulated inside the purge tank 51 can be ascertained. A second pressure sensor P2 and a second temperature sensor T2 are also provided to detect a pressure and a temperature of the low pressure refrigerant exiting the purge heat exchanger coil 55. The detection values of the second pressure sensor P2 and the second temperature sensor T2 can be used to determine a degree of superheating of the low pressure refrigerant exiting the purge heat exchanger coil 55. The degree of superheating can be used as an optional condition for controlling the third solenoid valve SV3 as explained later. A third temperature sensor T3 detects a temperature of gas in the purge vent line 60.

Figure 5:
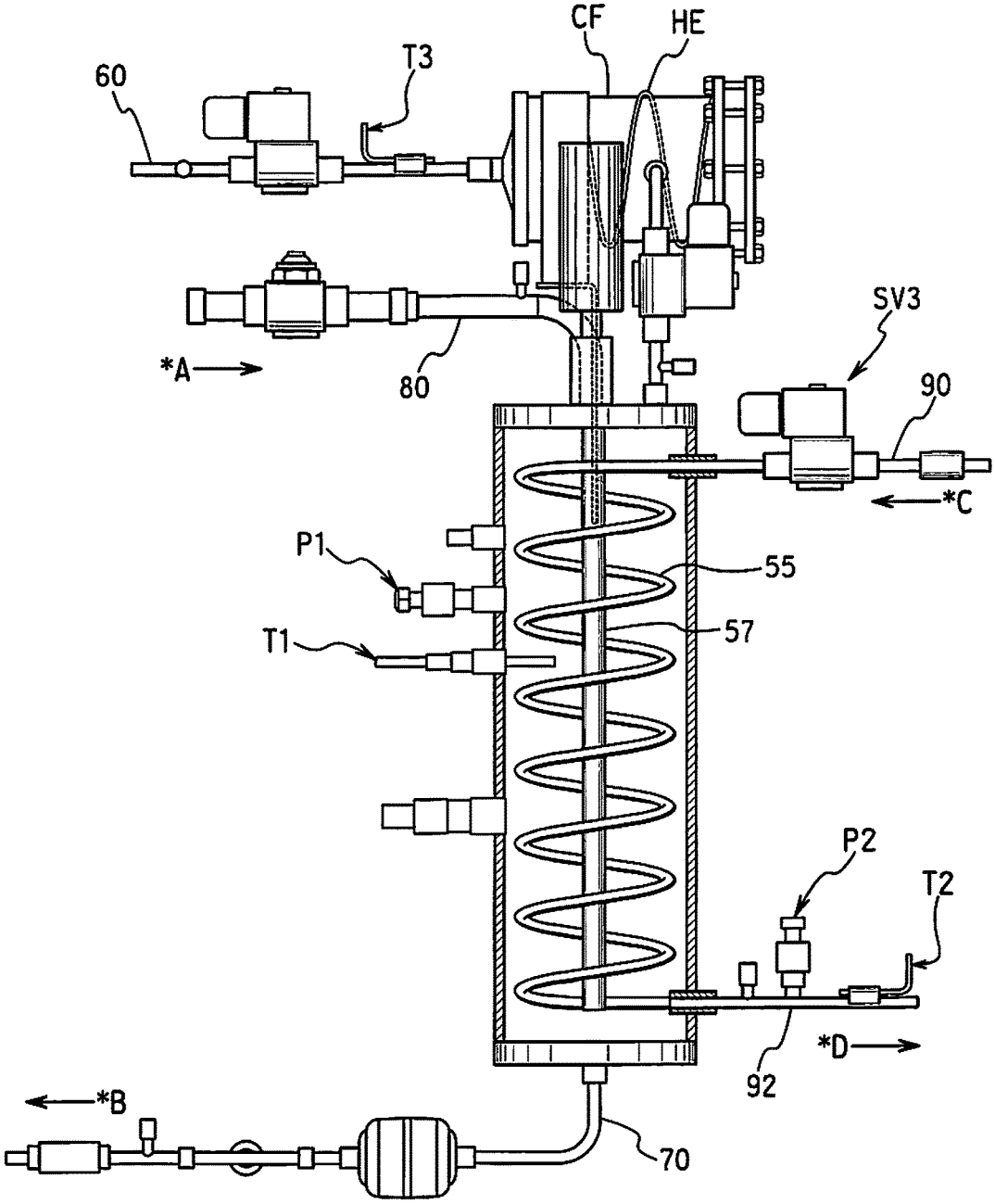
FIG. 5 is a side view of the non-condensable gas purge system shown in FIGS. 1-4 with the shell of the purge tank depicted as a cross section and the level sensor omitted to expose the heat exchanger coil and the internal pipe.
Figure 6:
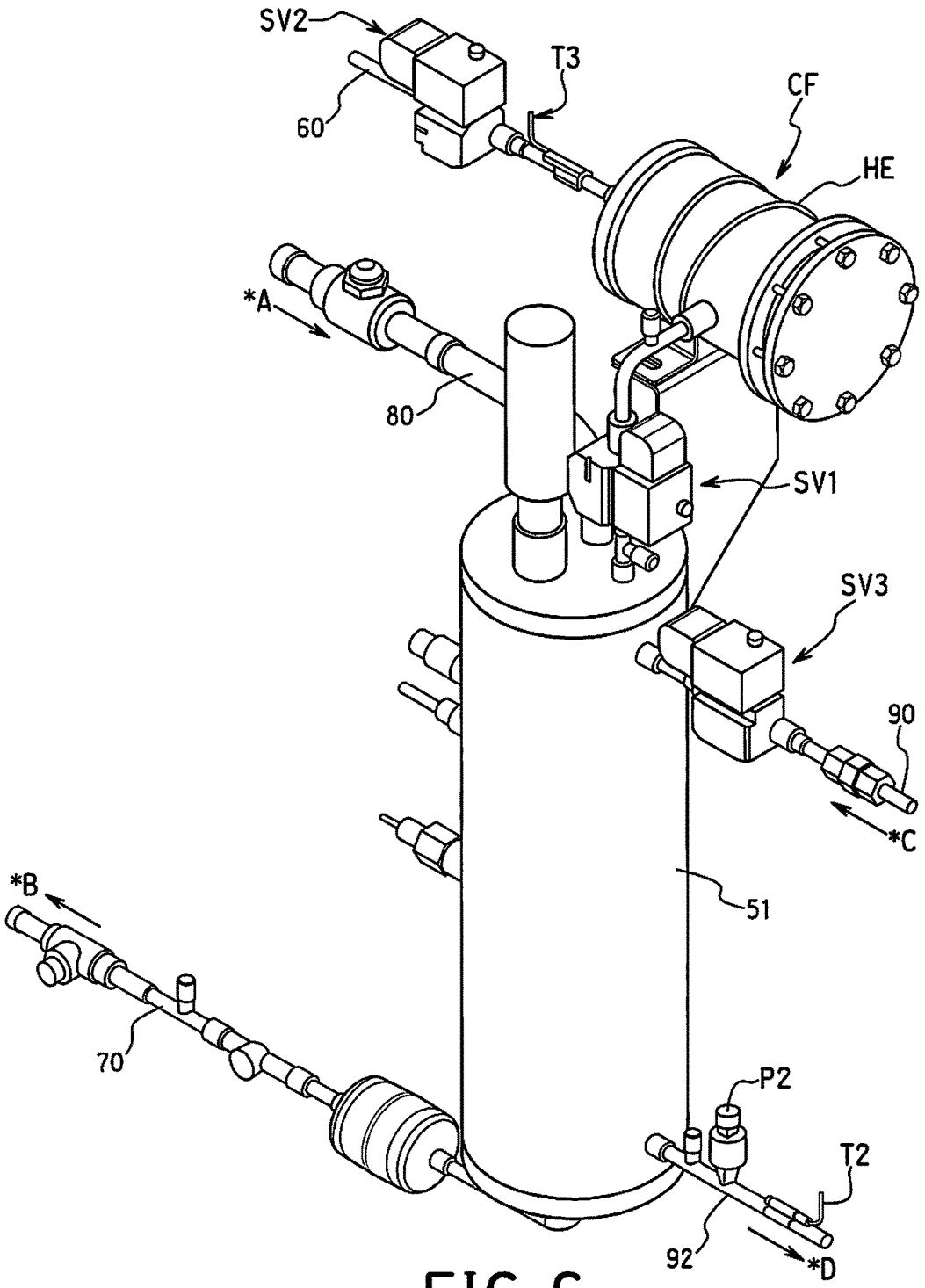
FIG. 6 is a perspective view of the non-condensable gas purge system shown in FIGS. 1-5 as seen from a different angle than in FIG. 4.

As shown in FIGS. 4-6, the purge tank 51 of the illustrated embodiment has the general form of a cylindrical shell that is elongated in the vertical direction and closed by plate-like covers on the upper and lower ends of the cylindrical shell. The purge heat exchanger coil 55 is a helical coil disposed inside the purge tank 51. An upper end of the purge heat exchanger coil 55 connects to a liquid feed line 90 through an upper portion of the shell wall, and a lower end of the purge heat exchanger coil 55 connects through a lower portion of the shell wall to a liquid return line 92 leading to the evaporator 28. The tank inlet 52 and the purge outlet 56 are formed through the upper plate-like cover of the purge tank 51 and connect to the vapor feed line 80 and the purge vent line 60, respectively. The carbon filter CF is mounted to the upper end of the purge tank 51. The first solenoid valve SV1 is also disposed above the upper end of the purge tank 51.

Since the non-condensable gas purge system 51 does not have a separate dedicated refrigeration circuit and, thus, does not require a dedicated compressor, the majority of the size of the non-condensable gas purge system 1 comes from the purge tank 51 and the carbon filter CF (e.g., see FIGS. 4-6). Consequently, the non-condensable gas purge system 51 can be made significantly smaller and more compact than a conventional purge system that includes a dedicated purge refrigerant circuit with a compressor. For example, in one prototype design, the cylindrical purge tank 51 has an outside diameter of approximately six inches (152 mm) and a height of approximately 20 inches (508 mm). A comparable conventional purge system using a non-low-pressure refrigerant (e.g., R404a) might have length, width, and height dimensions of, for example, 25 inches×20 inches×16 inches. Due to the smaller size of the non-condensable gas purge system 1 according to the illustrated embodiment, there is a larger degree of design freedom regarding the installation location of the non-condensable gas purge system 1 than with a conventional purge system. For example, the purge tank 51 together with the carbon filter CF can be attached to or mounted on the condenser 24 of the chiller system 10, as illustrated in FIGS. 7-9 of the drawings. In this arrangement, the purge tank 51 can be mounted directly to the outside of the condenser 24 or supported on the condenser 24 with a bracket B or other intermediate supporting structure (of course, the invention is not limited to an arrangement in which the purge tank 51 is attached to the condenser 24). The non-condensable gas purge system 1 is also less expensive and simpler to operate than the conventional purge system.

The operation of the non-condensable gas purge system 1 will now be explained with reference to the flowcharts of FIGS. 10-13. Since the non-condensable gas purge system 51 does not have a separate dedicated refrigeration circuit and, thus, does not require a dedicated compressor, the operation of the non-condensable purge system 51 is simple in comparison with conventional purge systems. Consequently, it is not necessary to provide a separate dedicated controller for controlling the non-condensable gas purge system 1. In the illustrated embodiment, the non-condensable gas purge system 1 is controlled by the controller 20 of the chiller system 10. Of course, it is also acceptable to provide a separate controller for the non-condensable gas purge system 1.

The non-condensable gas purge system I basically has three operating modes: a normal mode, a purge mode, and a recovery mode. The normal mode is the mode normally used when the chiller system 10 is operating. In the normal mode, the first and second solenoid valves SV1 and SV2 are closed and the third solenoid valve SV3 is generally held open. During the normal mode, non-condensable gases entering the liquid condensing chamber 53 via the tank inlet 52 are allowed to accumulate in the purge tank 51. The purge mode is a mode in which the non-condensable gases accumulated inside the purge tank 51 are vented to the ambient atmosphere. In the purge mode, the first solenoid valve SV1 and the second solenoid valve SV2 are opened and the third solenoid valve SV3 is controlled in the same manner as during the normal mode. As the non-condensable gases flow out through the purge vent line 60, refrigerant intermixed with the non-condensable gases is adsorbed by the carbon filter CF. The recovery mode is a mode in which refrigerant adsorbed by the carbon filter CF is de-adsorbed and returned to the liquid condensing chamber 53. During the recovery mode, the first solenoid valve SV1 is open, the second solenoid valve SV2 is closed, and the third solenoid valve SV3 is operated in the same manner as during the normal mode.

The operation of the non-condensable gas purge system 1 in each of the normal mode, the purge mode, and the recovery mode will now be explained in detail with reference to FIGS. 11-13. During the normal mode, the first and second solenoid valves SV1 and SV2 are closed as mentioned above. Meanwhile, the third solenoid valve SV3 is basically held open during the normal mode except that the controller 20 closes the third solenoid valve SV3 under certain conditions as explained below (e.g., when the level of liquid refrigerant accumulated in the bottom of the liquid condensing chamber 53 is too high and, optionally, when the degree of superheating is too low). The controller 20 also monitors the conditions inside the purge tank 51 (liquid condensing chamber 53) to determine if it is necessary to purge accumulated non-condensable gas from the purge tank 51. The heater HE and the vacuum pump VP remain off during the normal mode because the first and second solenoid valves SV1 and SV2 are closed and no gases are flowing out of the purge tank 51 via the purge vent line 60. Thus, during the normal mode, the controller 20 basically opens and closes the third solenoid valve SV3 as necessary and checks if it is necessary to switch to the purge mode.

Figure 11A:
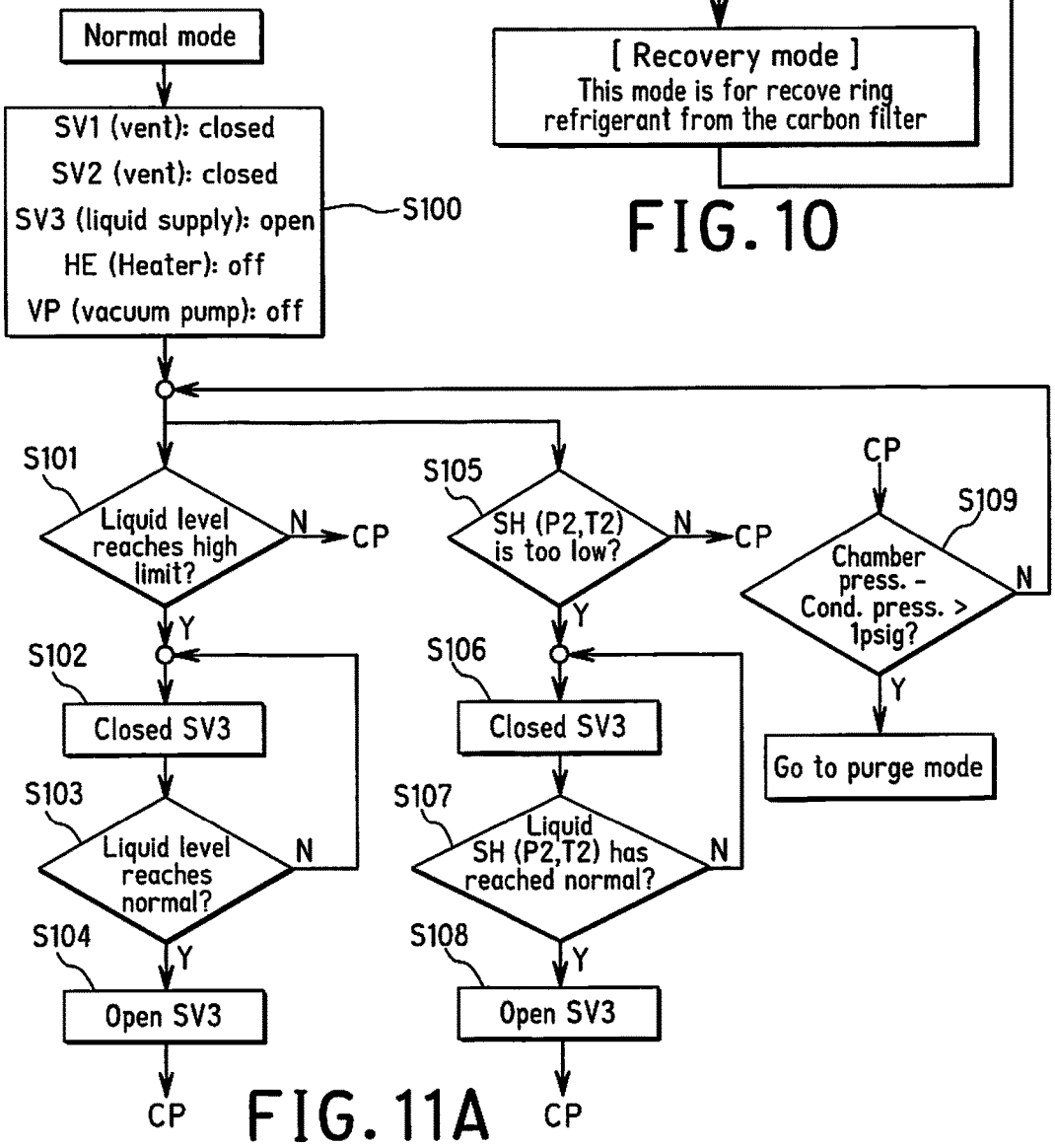
FIG. 11A is a flowchart illustrating the normal mode of the non-condensable gas purge system.

More specifically, referring to the flowchart shown in FIG. 11A, initially in step S100, the controller 20 closes the first and second solenoid valves SV1 and SV2 and opens the third solenoid valve SV3. Also, the heater HE and the vacuum pump VP are turned off. Next, in step S101 the controller 20 checks if the liquid level of the low pressure refrigerant in the liquid condensing chamber 53 has reached a high limit level. If so, then the controller 20 proceeds to step S102 and closes the third solenoid valve SV3. In step S103, the controller 20 determines if the liquid level of the low pressure refrigerant in the liquid condensing chamber 53 has decreased to the normal liquid level. If so, then the controller proceeds to step S104 and opens the third solenoid valve SV3. Otherwise, the controller repeats steps S102 and S103 until the liquid level of the low pressure refrigerant in the liquid condensing chamber 53 reaches the normal liquid level.

Meanwhile, the controller 20 executes step S105 to determine if a degree of superheating (SH) of the low pressure refrigerant exiting the purge heat exchanger coil 55 is too low based on the temperature and pressure detected by sensors T2 and P2 shown in FIGS. 3 and 4. For example, the controller 20 determines compares the temperature detected by the temperature sensor T2 to the saturation temperature corresponding to the pressure detected by the pressure sensor P2. If the degree of superheating is too low (e.g., the detected temperature is equal to or smaller than a lower limit temperature value), then the controller 20 proceeds to step S106 and closes the third solenoid valve SV3. Then, in step S107, the controller 20 determines if the degree of superheating of the low pressure refrigerant exiting the purge heat exchanger coil 55 has returned to normal (e.g., by determining if the detected temperature is equal to or larger than a normal temperature value). If so, then the controller proceeds to step S108 and opens the third solenoid valve SV3. Otherwise, the controller repeats steps S106 and S107 until the degree of superheating of the low pressure refrigerant exiting the purge heat exchanger coil 55 reaches the normal degree.

If the result of either of steps S101 and S105 is "No," then the controller 20 proceeds to step S109. The controller also proceeds to step S109 after executing either of steps S104 and S108. In step S109, the controller 20 checks if a difference between the pressure inside the liquid condensing chamber 53 and a condensation temperature of the low pressure refrigerant is larger than 1 psig. If the pressure difference is larger than 1 psig, then the controller 20 switches to the purge mode. Otherwise, the controller 20 returns to steps S101 and S105.

Figure 11B:
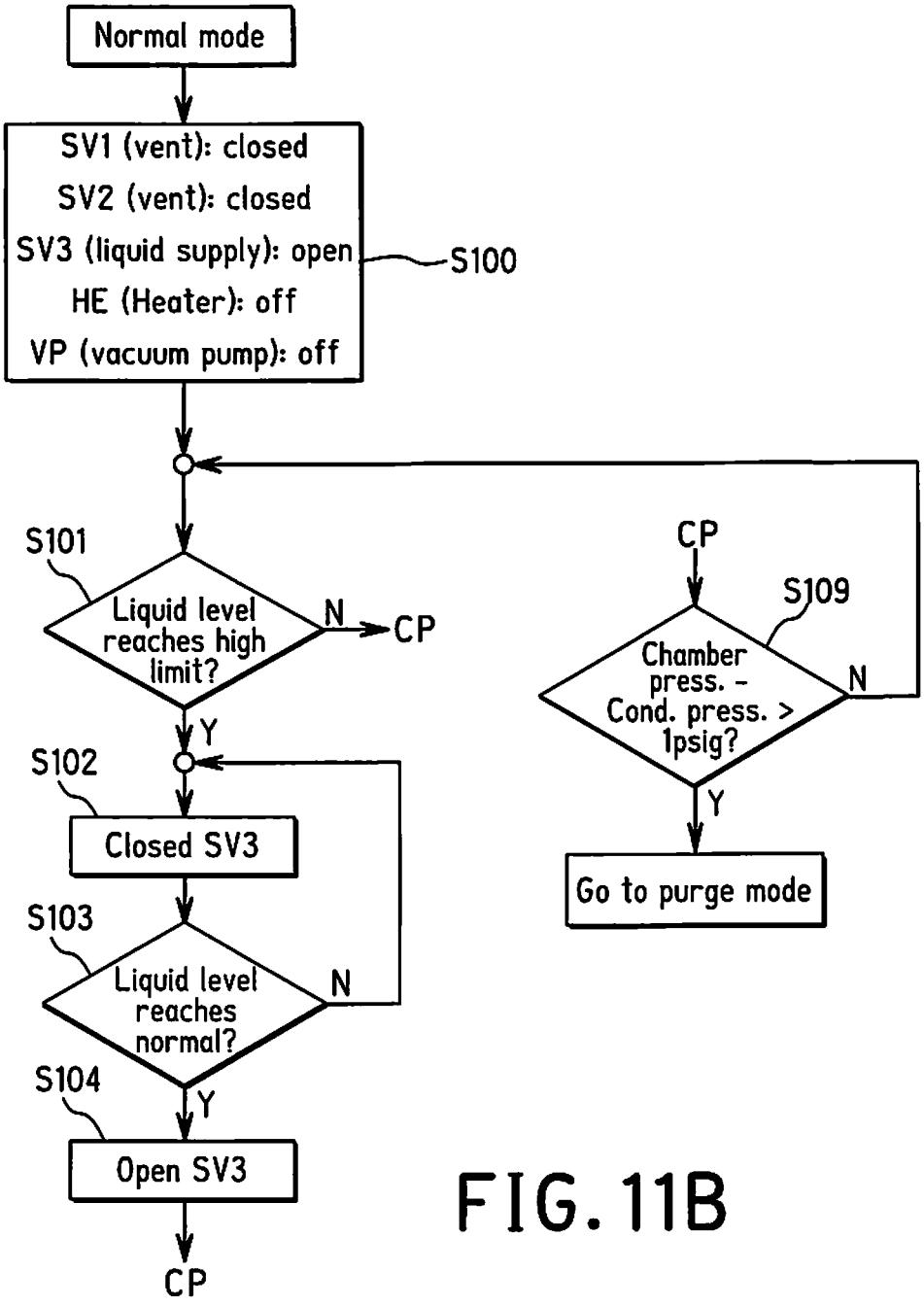
FIG. 11B is a flowchart illustrating the normal mode that is similar to the flowchart of FIG. 11A accept that steps for controlling the third solenoid valve based on the degree of superheating of the refrigerant exiting the purge heat exchanger coil have been omitted.

Optionally, as shown in FIG. 11B, it is acceptable to omit steps S105-S108. In other words, it is acceptable to control the third solenoid valve SV3 based solely on the liquid level of the low pressure refrigerant detected by the level switch LS.

In this way, during the normal mode, the controller 20 basically opens and closes the third solenoid valve SV3 as necessary based on the liquid level of the low pressure refrigerant in the liquid condensing chamber 53 and, optionally, the degree of superheating of the low pressure refrigerant exiting the purge heat exchanger coil 55. The controller 20 also continuously checks if it is necessary to switch to the purge mode.

Figure 12A:
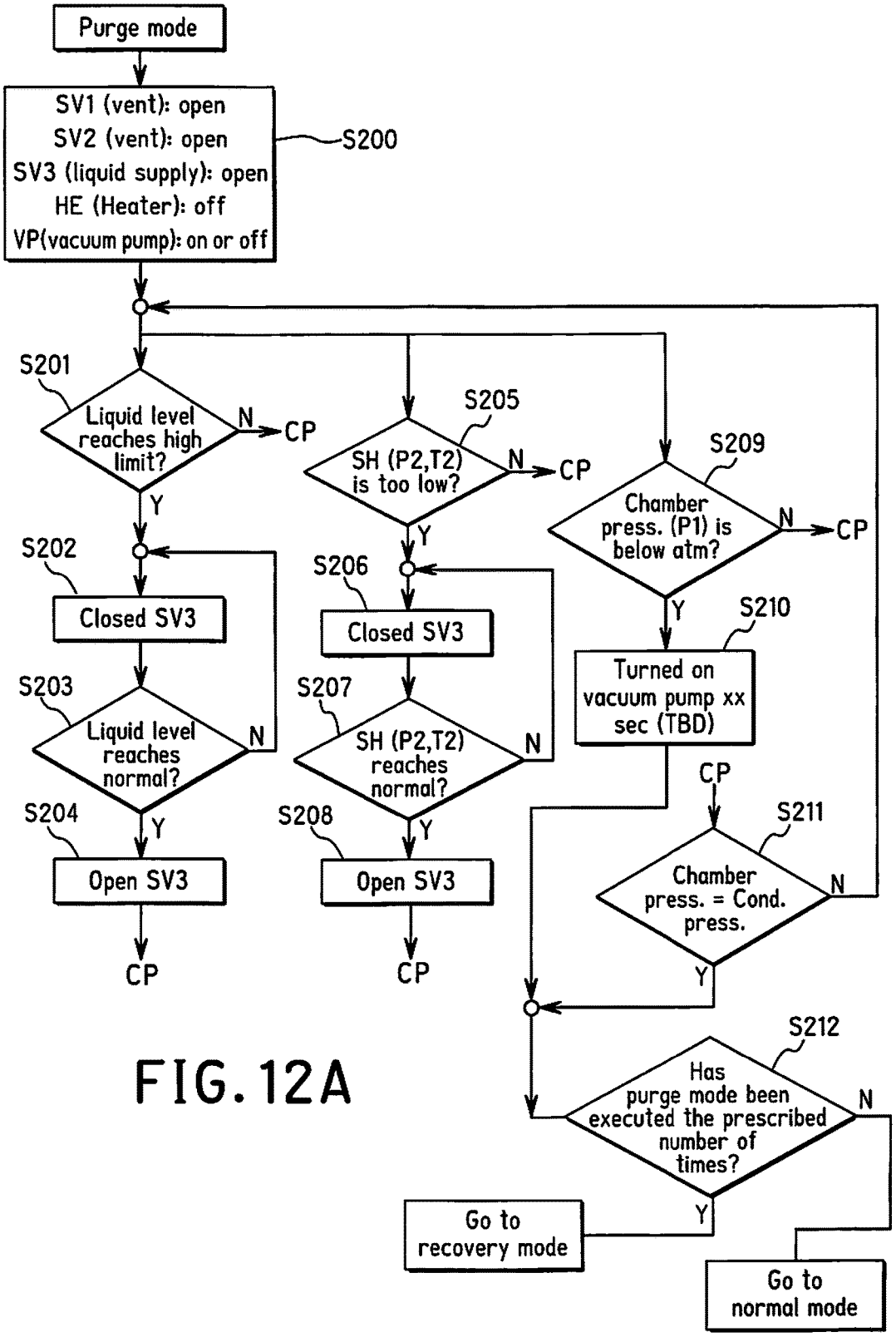
FIG. 12A is a flowchart illustrating the purge mode of the non-condensable gas purge system.

The purge mode will now be explained with reference to FIG. 12A. In the purge mode, the controller 20 controls the third solenoid valve SV3 in the same manner as during the normal mode. Thus, since steps S201 to S208 are identical to steps S101 to S108 shown in FIG. 11 A, an explanation of steps S201 to S208 will be omitted. Initially, when the controller 20 switches to the purge mode, the controller 20 proceeds to step S200 and opens the first and second solenoid valves SV1 and SV2. The heater HE and the vacuum pump VP are also turned off (although the vacuum pump VP may be turned on during the purge mode depending on step S210). Then, steps S209 and S210 are executed along with steps S201 to S208.

In step S209, the controller 20 determines if the pressure inside the liquid condensing chamber 53 is lower than 1 atmosphere based on the detection value of the first pressure sensor P1. If the pressure inside the liquid condensing chamber 53 is lower than 1 atmosphere, then the controller 20 proceeds to step S210 and turns on the vacuum pump VP for a prescribed amount of time. Then, the controller 20 proceeds to step S212 and determines if the purge mode has been executed a prescribed number of times (e.g., ten times with a purge duration of 30 minutes each time). Alternatively, in step S212 the controller 20 may determine if the purge mode has been executed a prescribed total amount of time (e.g., five hours) since the last time the recovery mode was executed. If the purge mode has been executed the prescribed number of times, then the controller 20 switches to the recovery mode. Meanwhile, if the result of step S209 is "No," then the controller 20 proceeds to step S211 and determines if the pressure inside the liquid condensing chamber (detected by the first pressure sensor P1) is equal to the condensation pressure of the low pressure refrigerant. If the result of step S211 is "Yes," then the controller 20 proceeds to switch to step S212. Otherwise, the controller 20 returns to steps S201, S205, and S209.

Figure 12B:
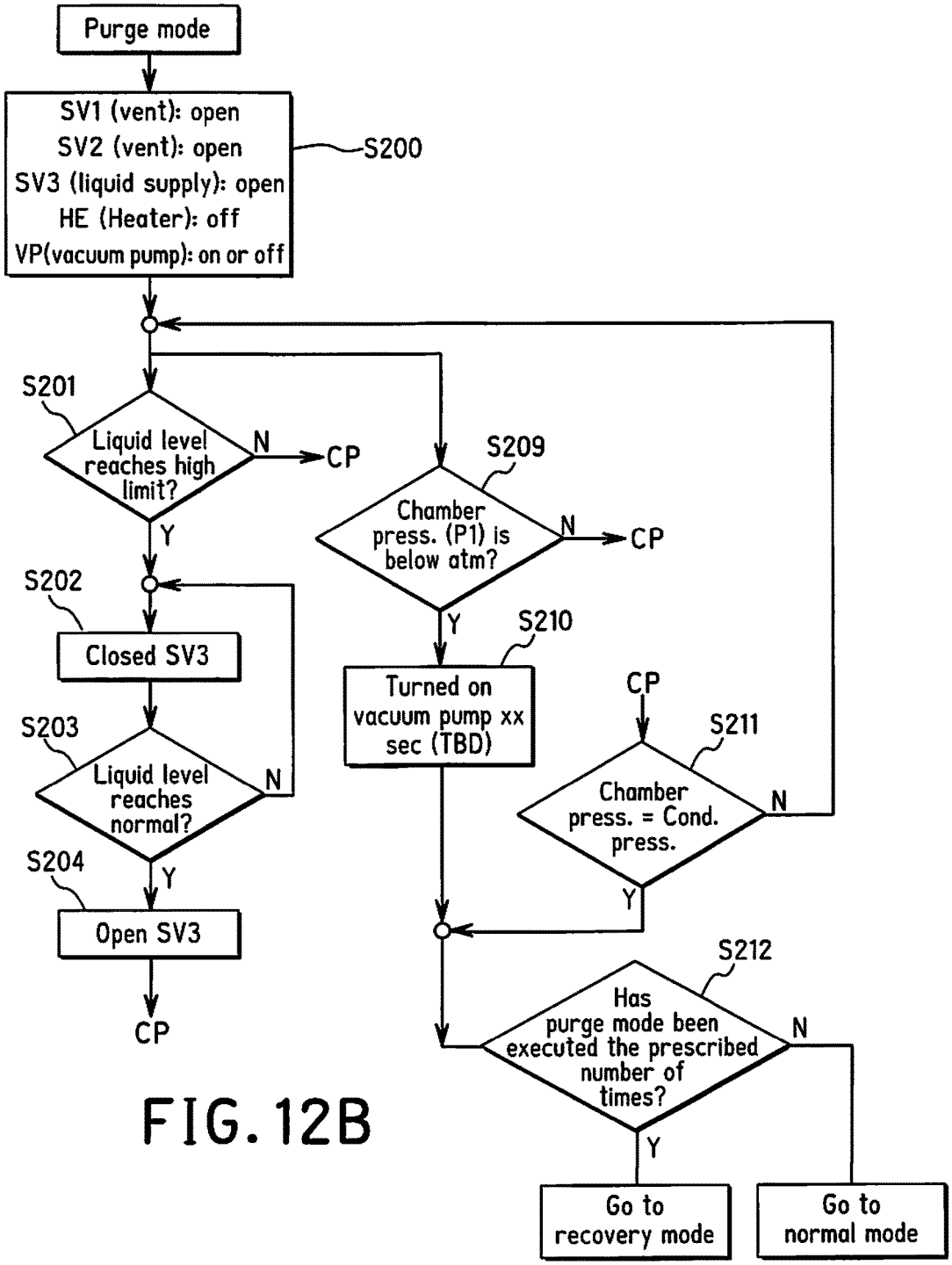
FIG. 12B is a flowchart illustrating the purge mode that is similar to the flowchart of FIG. 12A accept that steps for controlling the third solenoid valve based on the degree of superheating of the refrigerant exiting the purge heat exchanger coil have been omitted.

Optionally, as shown in FIG. 12B, it is acceptable to omit steps S205-S208. In other words, similarly to the normal mode, it is acceptable to control the third solenoid valve SV3 based solely on the liquid level of the low pressure refrigerant detected by the level switch LS during the purge mode.

In this way, during the purge mode, the controller 20 continues to open and close the third solenoid valve SV3 as necessary based on the liquid level of the low pressure refrigerant in the liquid condensing chamber 53 and, optionally, the degree of superheating of the low pressure refrigerant exiting the purge heat exchanger coil 55. The controller 20 also determines if it is necessary to operate the vacuum pump VP based on the pressure detected by the first pressure sensor P1. Additionally, the controller 20 continuously checks if it is necessary to switch to the recovery mode.

Figure 13A:
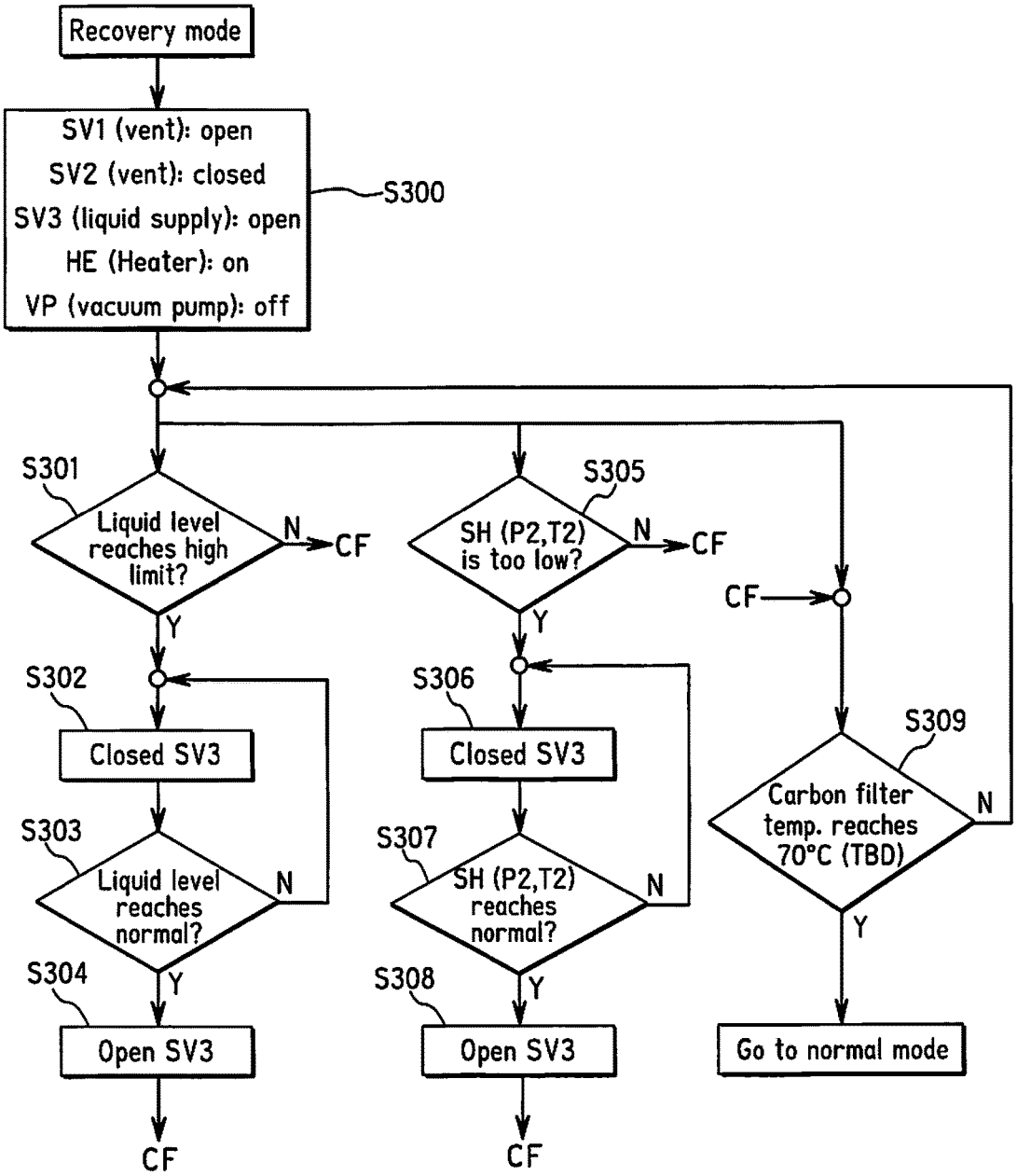
FIG. 13A is a flowchart illustrating the recovery mode of the non-condensable gas purge system.

The recovery mode will now be explained with reference to FIG. 13A. In the recovery mode, the controller 20 controls the third solenoid valve SV3 in the same manner as during the normal mode and the purge mode. Thus, since steps S301 to S308 are identical to steps S101 to S108 shown in FIG. 11 A and steps S201 to S208 shown in FIG. 12A, an explanation of steps S301 to S308 will be omitted. Initially, when the controller 20 switches to the recovery mode, the controller 20 proceeds to step S300 and opens the first solenoid valve SV1 and closes the second solenoid valve SV2. The heater HE is turned on and the vacuum pump VP is turned off. Then, step S309 is executed along with steps S301 to S308.

In step S309, the controller 20 determines if a temperature of the carbon filter CF has reached a prescribed temperature, e.g., 70° C. If the temperature of the carbon filter CF is equal to or larger than the prescribed temperature, then the controller 20 returns to the normal mode. Otherwise, the controller 20 returns to steps S301, S305, and S309.

Figure 13B:
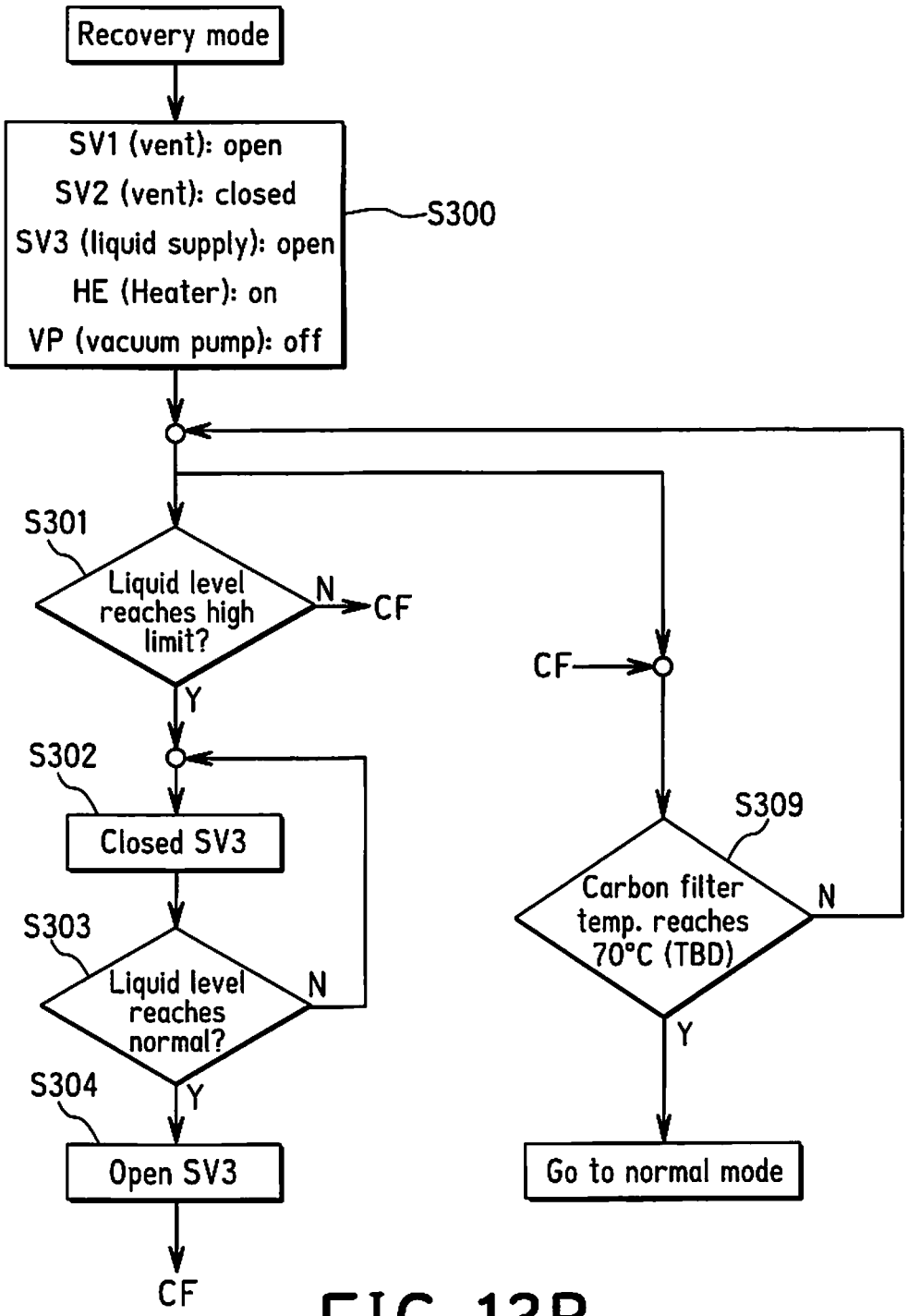
FIG. 13B is a flowchart illustrating the recovery mode that is similar to the flowchart of FIG. 13A accept that steps for controlling the third solenoid valve based on the degree of superheating of the refrigerant exiting the purge heat exchanger coil have been omitted.

Optionally, as shown in FIG. 13B, it is acceptable to omit steps S305-S308. In other words, similarly to the normal mode, it is acceptable to control the third solenoid valve SV3 based solely on the liquid level of the low pressure refrigerant detected by the level switch LS during the purge mode.

In this way, during the recovery mode, the controller 20 continues to open and close the third solenoid valve SV3 as necessary based on the liquid level of the low pressure refrigerant in the liquid condensing chamber 53 and, optionally, the degree of superheating of the low pressure refrigerant exiting the purge heat exchanger coil 55. The controller 20 also determines if the recovery of refrigerant from the carbon filter CF has been completed by monitoring the temperature of the carbon filter CF. When it determines that the recovery has been completed, the carbon filter CF ends the recovery mode and returns to the normal mode.

As mentioned previously, in the present invention, the same controller as controls the chiller refrigeration circuit can also be used to control the non-condensable gas purge system because the non-condensable gas purge system is comparatively simple to operate (of course, it is also acceptable to use a separate controller for the purge system 1). In the illustrated embodiment, the chiller controller 20 is conventional except for the programming required to execute the normal mode, the purge mode, and the recovery mode operations (see FIGS. 11-13) of the non-condensable gas purge system 1. The controller 20 includes at least one microprocessor or CPU, an Input/output (I/O) interface, Random Access Memory (RAM), Read Only Memory (ROM), a storage device forming a computer readable medium programmed to execute one or more control programs to control the chiller system 10 or 10' and the non-condensable gas purge system 1. The chiller controller 20 may optionally include an input interface such as a keypad to receive inputs from a user and a display device used to display various parameters to a user. The parts and programming are conventional, and thus, will not be discussed in detail herein, except as needed to understand the embodiment(s).

The controller 20 receives signals from the first pressure sensor P1, the first temperature sensor T1, the second pressure sensor P2, the second temperature sensor T2, the level sensor LS and other sensors (not shown) to control the chiller system 10 or 10' and the non-condensable gas purge system 1. The controller 20 also transmits electrical signals to the compressor 22 (or 22') of the chiller system 10 (or 10') and to the solenoid valves SV1, SV2, and SV3, the heater HE, and the vacuum pump VP of the non-condensable gas purge system 1. More specifically, the controller 20 is programmed to control the rotation speed of the motor 38 to control the capacity of the compressor 22 (or 22') in a conventional manner. Additionally, the controller 20 is programmed to control the opening degree of the expansion valve 26 to control the capacity of the chiller system 10 in a conventional manner. The controller 20 is also programmed to control the non-condensable gas purge system 1 as explained above based on information obtained from the sensors P1, P2, T1, T2 and the level switch LS.

According to calculations, it is estimated that the flow of non-condensable gas to the purge tank will be 4.36 cc/hour during operation of the chiller system at a minimum temperature of −10° C. (at 4.37 pisa), and 1.19 cc/hour while the chiller system is stopped at a machine ambient temperature of 0° C. (at 6.94 pisa). Also, the mass ratio of non-condensable gas with respect to refrigerant flowing into the purge tank is 5% non-condensable gas versus 95% refrigerant (i.e., 0.15E-3 kg/hr of non-condensable gas versus 2.89E-3 kg/hr of refrigerant, combined total 3.04E-3 kg/hr). The surface area of the purge heat exchanger coil is estimated to be 6.69E-2 $m^2$. The estimated frequency of executing the purge mode is 30 minutes per day. This is much smaller than current conventional purge systems. The rate at which refrigerant discharged from the purge tank is adsorbed by the carbon filter is estimated to be 1.5E-3 kg/hr. The required frequency of executing the recovery mode is estimated to be as low as once per 100 days. However, it is anticipated that the recovery mode will be executed once every ten days to prevent the carbon filter from becoming saturated with refrigerant.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only a selected embodiment has been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired, so long as the purge tank 51 is arranged generally higher than the condenser. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

As used herein, such directional terms as "vertical," "up", "down", "upper," "lower," "higher," "lower," "above," "below", "upward", "downward", "top", and "bottom", as well as any other similar directional terms, refer to those directions of the components and or the system as a whole in an installed state. Accordingly, these directional terms, as utilized to describe the non-condensable gas purge system and the refrigeration circuit for a chiller system should be interpreted relative to a chiller system in typically installed state.

Additionally, the term "low pressure refrigerant" as used herein refers to any refrigerant or blend of refrigerants that is suitable for use in the refrigeration circuit of a low-pressure chiller system. A low pressure refrigerant is typically characterized by having an evaporation pressure equal to or lower than atmospheric pressure. Although the low pressure refrigerant R1233zd is used in the illustrated embodiment, one of ordinary skill in the refrigeration field will recognize that the present invention is not limited to R1233zd. The low pressure refrigerant R1233zd is a candidate for centrifugal chiller applications because it is non-flammable, non-toxic, low cost, and has a high COP compared to other refrigerants like R1234ze, which are current major alternatives for the refrigerant R134a. R1233zd is also a low GWP (Global Warming Potential) refrigerant and, thus, has the additional advantage of having a lower impact on global warming than conventional refrigerants having a higher GWP.

Also it will be understood that although the terms "first" and "second" may be used herein to describe various components these components should not be limited by these terms. These terms are only used to distinguish one component from another. Thus, for example, a first component discussed above could be termed a second component and vice versa without departing from the teachings of the present invention. The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives.

What is claimed is:

1. A non-condensable gas purge system for a refrigeration circuit including a compressor, a condenser, an expansion valve, and an evaporator connected to form a loop, the refrigeration circuit containing a low pressure refrigerant, the purge system comprising a purge tank, an interior of the purge tank defining a liquid condensing chamber, the purge tank having a tank inlet for receiving the low pressure refrigerant from the condenser, a tank outlet for returning the low pressure refrigerant from the liquid condensing chamber to the evaporator, and a purge outlet for purging non-condensable gas from the liquid condensing chamber to an ambient atmosphere;

a purge heat exchanger coil disposed inside the liquid condensing chamber of the purge tank, an upper end of the purge heat exchanger coil configured and arranged to be fluidly connected to a coil liquid supply line of the refrigeration circuit through an upper portion of the purge tank such that the low pressure refrigerant contained in the loop passes through the purge heat exchanger coil without using a dedicated purge system compressor.

2. The non-condensable gas purge system according to claim 1, wherein the tank inlet is provided on an upper portion of the purge tank and the tank outlet is provided on a lower portion of the purge tank; and an internal pipe is provided inside the liquid condensing chamber and connected to the tank inlet, the internal pipe extending downward from the tank inlet.

3. The non-condensable gas purge system according to claim 2, wherein the internal pipe is dimensioned such that a bottom end of the internal pipe is disposed below a position corresponding to a predetermined normal liquid level of the low pressure refrigerant in a liquid state collected in the liquid condensing chamber.

4. The non-condensable gas purge system according to claim 1, wherein the purge tank is configured to be attached to the condenser.

5. The non-condensable gas purge system according to claim 1, further comprising a purge vent line connected to the purge outlet to guide non-condensable gas from the liquid condensing chamber to an ambient atmosphere;

a carbon filter arranged in the purge vent line between the purge outlet and an ambient atmosphere end of the purge vent line, the carbon filter being configured to extract the low pressure refrigerant from the non-condensable gas;

a first solenoid valve arranged in the purge vent line between the purge outlet and the carbon filter; and a second solenoid valve arranged in the purge vent line between the carbon filter and the ambient atmosphere end of the purge vent line.

6. The non-condensable gas purge system according to claim 5, further comprising a vacuum pump arranged in the purge vent line between the second solenoid valve and the ambient atmosphere end of the purge vent line, the vacuum pump being configured to draw the non-condensable gas from the liquid condensing chamber.

7. The non-condensable gas purge system according to claim 5, further comprising a vapor feed line having one end connected to the tank inlet, the vapor feed line being arranged to feed the low pressure refrigerant from the condenser to the liquid condensing chamber;

a third solenoid valve arranged in the coil liquid supply line; and a liquid return line having one end connected to the tank outlet, the liquid return line being arranged to return the low pressure refrigerant from the liquid condensing chamber to the evaporator.

8. The non-condensable gas purge system according to claim 7, further comprising a liquid level detector arranged and configured to detect a level of the low pressure refrigerant in a liquid state collected in the liquid condensing chamber; and a controller operationally coupled to the first, second, and third solenoid valves and arranged to receive a signal from the liquid level detector indicating the detected level of the low pressure refrigerant, the controller being programmed to open and close the third solenoid valve in response to the level of low pressure refrigerant detected by the liquid level detector.

9. The non-condensable gas purge system according to claim 8, wherein the liquid level detector is arranged and configured to detect at least two different levels of the low pressure refrigerant in the liquid state collected in the liquid condensing chamber, the two levels including a predetermined normal liquid level and a predetermined high liquid level that is larger than the predetermined normal liquid level, and the controller closes the third solenoid valve upon the detected level of the low pressure refrigerant becoming equal to or larger than the predetermined high liquid level, and the controller opens the third solenoid valve upon the detected level becoming equal to or smaller than the predetermined normal liquid level after closing the third solenoid valve.

10. The non-condensable gas purge system according to claim 9, wherein the controller is further programed to close the third solenoid valve when a superheating temperature of the low pressure refrigerant exiting the purge heat exchanger coil is smaller than a prescribed superheating temperature value.

11. The non-condensable gas purge system according to claim 8, wherein the controller is programmed to operate the non-condensable gas purge system in one of a normal mode in which the first solenoid valve and the second solenoid valve remain closed such that communication between the liquid condensing chamber and the ambient atmosphere is prevented;

a purge mode in which the controller opens the first and second solenoid valves to vent the non-condensable gas from the liquid condensing chamber to the atmosphere while the carbon filter extracts the low pressure refrigerant from the non-condensable gas; and a recovery mode in which the controller opens the first solenoid valve and closes the second solenoid valve to recover at least a portion of the extracted low pressure refrigerant to the liquid condensing chamber from the carbon filter.

12. The non-condensable gas purge system according to claim 11, further comprising a pressure detector arranged and configured to detect a pressure of the non-condensable gas inside the liquid condensing chamber, the controller being arranged to receive a signal indicating the pressure detected by the pressure detector and programmed to operate the non-condensable gas purge system in the purge mode when the pressure detected by the pressure detector is equal to or higher than a first predetermined pressure.

13. The non-condensable gas purge system according to claim 11, further comprising a vacuum pump arranged in the purge vent line between the second solenoid valve and the ambient atmosphere end of the purge vent line, the controller being programmed to operate the vacuum pump during the purge mode if the pressure detected by the pressure detector becomes lower than a value corresponding to an ambient atmospheric pressure.

14. The non-condensable gas purge system according to claim 11, wherein the controller is programed to operate the non-condensable gas purge system in the recovery mode when it is determined that the carbon filter is saturated with the extracted low pressure refrigerant.

15. The non-condensable gas purge system according to claim 14, further comprising a heater device arranged and configured to heat the carbon filter, the controller being programmed to operate the heater device during the recovery mode.

16. A refrigeration circuit for a chiller system, the refrigeration circuit comprising:

a loop including a compressor, a condenser, an expansion valve, and an evaporator connected together, the loop containing a low pressure refrigerant; and a non-condensable gas purge system including a purge tank, an interior of the purge tank defining a liquid condensing chamber, the purge tank having a tank inlet, a tank outlet, and a purge outlet;

a vapor feed line connected to the tank inlet, the vapor feed line being arranged to feed the low pressure refrigerant from the condenser to the liquid condensing chamber;

a liquid return line connected to the tank outlet, the liquid return line being arranged to return the low pressure refrigerant from the liquid condensing chamber to the evaporator;

a purge vent line connected to the purge outlet, the purge vent line being arranged to guide non-condensable gas from the liquid condensing chamber to an ambient atmosphere; and a purge heat exchanger coil disposed inside the liquid condensing chamber of the purge tank, an upper end of the purge heat exchanger coil being fluidly connected to a coil liquid supply line of the refrigerant circuit through an upper portion of the purge tank such that the low pressure refrigerant contained in the loop passes through the purge heat exchanger coil without using a dedicated purge system compressor.

17. The refrigeration circuit recited in claim 16, wherein the purge tank is disposed higher than the condenser in a vertical direction of the refrigeration circuit; and the purge tank is disposed higher than a bottom of the evaporator in the vertical direction.

18. The refrigeration circuit recited in claim 16, wherein the upper end of the purge heat exchanger coil is connected to a bottom of the condenser via the coil liquid supply line; and a lower end of the purge heat exchanger coil is connected to the evaporator.

19. The refrigeration circuit recited in claim 16, wherein the compressor is a two-stage compressor having a first stage and a second stage;

an economizer is connected to the refrigeration circuit between the two-stage compressor and the expansion valve;

the upper end of the purge heat exchanger coil is connected via the coil liquid supply line to a bottom of the condenser or to a liquid line connected between the economizer and the expansion valve; and a lower end of the purge heat exchanger coil is connected to a bottom of the evaporator.

20. The refrigeration circuit recited in claim 16, further comprising a controller arranged and programmed to control a refrigeration cycle of the loop and to control operation of the non-condensable gas purge system.

* * * * *